US008302661B2

(12) United States Patent
Forbes Jones et al.

(10) Patent No.: US 8,302,661 B2
(45) **Date of Patent: *Nov. 6, 2012**

(54) CASTING APPARATUS AND METHOD

(75) Inventors: Robin M. Forbes Jones, Charlotte, NC (US); Sterry A. Shaffer, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/420,910

(22) Filed: Mar. 15, 2012

(65) Prior Publication Data

US 2012/0168110 A1 Jul. 5, 2012

Related U.S. Application Data

(63) Continuation of application No. 13/108,402, filed on May 16, 2011, now Pat. No. 8,156,996, which is a continuation of application No. 12/861,033, filed on Aug. 23, 2010, now Pat. No. 7,963,314, which is a continuation of application No. 11/949,808, filed on Dec. 4, 2007, now Pat. No. 7,798,199.

(51) Int. Cl.
*B22D 23/00* (2006.01)

(52) U.S. Cl. ..... 164/271; 164/46

(58) Field of Classification Search ..... 164/46, 164/271

See application file for complete search history.

(56) References Cited

U.S. PATENT DOCUMENTS

| | | | |
|---|---|---|---|
| 3,005,246 | A | 10/1961 | Murphy et al. |
| 3,072,982 | A | 1/1963 | Gordon et al. |
| 3,101,515 | A | 8/1963 | Hanks |
| 3,157,922 | A | 11/1964 | Helmut |
| 3,343,828 | A | 9/1967 | Hunt |
| 3,389,208 | A | 6/1968 | Roberts et al. |
| 3,420,977 | A | 1/1969 | Hanks et al. |
| 3,519,059 | A | 7/1970 | Voskoboinikov et al. |
| 3,547,622 | A | 12/1970 | Hutchinson |
| 3,576,207 | A | 4/1971 | Grenfell et al. |

(Continued)

FOREIGN PATENT DOCUMENTS

| | | | |
|---|---|---|---|
| CA | 2048836 | A1 | 4/1992 |

(Continued)

OTHER PUBLICATIONS

W. M. Clark, et al., "Ion Plasma Electron Gun Research," Dec. 1977, 43 pages.

(Continued)

*Primary Examiner* — Kuang Lin

(74) *Attorney, Agent, or Firm* — K & L Gates LLP; Patrick J. Viccaro; John E. Grosselin, III

(57) ABSTRACT

A nucleated casting apparatus including an atomizing nozzle configured to produce a droplet spray of a metallic material, a mold configured to receive the droplet spray and form a preform therein, and a gas injector which can limit, and possibly prevent, overspray from accumulating on the mold. The gas injector can be configured to produce a gas flow which can impinge on the droplet spray to redirect at least a portion of the droplet spray away from a side wall of the mold. In various embodiments, the droplet spray may be directed by the atomizing nozzle in a generally downward direction and the gas flow may be directed in a generally upward direction such that the gas flow circumscribes the perimeter of the mold.

26 Claims, 23 Drawing Sheets

U.S. PATENT DOCUMENTS 3,627,293 A 12/1971 Sperner
3,690,635 A 9/1972 Harker et al.
3,702,630 A 11/1972 Peytavin et al.
3,737,305 A 6/1973 Blayden et al.
3,817,503 A 6/1974 Lafferty et al.
3,825,415 A 7/1974 Johnston et al.
3,826,301 A 7/1974 Brooks
3,868,987 A 3/1975 Galey et al.
3,896,258 A 7/1975 Hanks
3,909,921 A 10/1975 Brooks
3,970,892 A 7/1976 Wakalopulos
3,972,713 A 8/1976 Muzyka et al.
3,985,177 A 10/1976 Buehler
3,988,084 A 10/1976 Esposito et al.
3,989,091 A 11/1976 Medovar et al.
4,025,818 A 5/1977 Giguere et al.
4,058,697 A 11/1977 Sokolov et al.
4,061,944 A 12/1977 Gay
4,062,700 A 12/1977 Hayami et al.
4,066,117 A 1/1978 Clark et al.
4,136,527 A 1/1979 Kading
4,190,404 A 2/1980 Drs et al.
4,221,587 A 9/1980 Ray
4,261,412 A 4/1981 Soykan et al.
4,264,641 A 4/1981 Mahoney et al.
4,272,463 A 6/1981 Clark et al.
4,305,451 A 12/1981 Ksendzyk et al.
4,343,433 A 8/1982 Sickles
4,426,141 A 1/1984 Holcomb
4,441,542 A 4/1984 Pryor et al.
4,449,568 A 5/1984 Narasimham
4,471,831 A 9/1984 Ray
4,482,376 A 11/1984 Tarasescu et al.
4,544,404 A 10/1985 Yolton et al.
4,575,325 A 3/1986 Duerig et al.
4,596,945 A 6/1986 Schumacher et al.
4,619,597 A 10/1986 Miller
4,619,845 A 10/1986 Ayers et al.
4,631,013 A 12/1986 Miller
4,642,522 A 2/1987 Harvey et al.
4,645,978 A 2/1987 Harvey et al.
4,689,074 A 8/1987 Seaman et al.
4,694,222 A 9/1987 Wakalopulos
4,697,631 A 10/1987 Bungeroth et al.
4,730,661 A 3/1988 Stephan
4,738,713 A 4/1988 Stickle
4,755,722 A 7/1988 Wakalopulos
4,762,553 A 8/1988 Savage et al.
4,762,975 A 8/1988 Mahoney et al.
4,769,064 A 9/1988 Buss et al.
4,779,802 A 10/1988 Coombs
4,786,844 A 11/1988 Farrell et al.
4,788,016 A 11/1988 Colclough et al.
4,801,411 A 1/1989 Wellinghoff et al.
4,801,412 A 1/1989 Miller
4,838,340 A 6/1989 Entrekin et al.
4,842,170 A 6/1989 Del Vecchio et al.
4,842,704 A 6/1989 Collins et al.
4,910,435 A 3/1990 Wakalopulos
4,916,361 A 4/1990 Schumacher et al.
4,919,335 A 4/1990 Hobson et al.
4,926,923 A 5/1990 Brooks et al.
4,931,091 A 6/1990 Waite et al.
4,932,635 A 6/1990 Harker
4,936,375 A 6/1990 Harker
4,938,275 A 7/1990 Leatham et al.
4,955,045 A 9/1990 Friede et al.
4,961,776 A 10/1990 Harker
5,004,153 A 4/1991 Sawyer
5,074,933 A 12/1991 Ashok et al.
5,084,091 A 1/1992 Yolton
5,100,463 A 3/1992 Harker
5,102,449 A 4/1992 Ducrocq et al.
5,102,620 A 4/1992 Watson et al.
5,104,634 A 4/1992 Calcote
5,142,549 A 8/1992 Bremer
5,160,532 A 11/1992 Benz et al.
5,167,915 A 12/1992 Yamashita et al.
5,176,874 A 1/1993 Mourer et al.
5,222,547 A 6/1993 Harker
5,226,946 A 7/1993 Diehm et al.
5,240,067 A 8/1993 Hatch
5,263,044 A 11/1993 Bremer
5,266,098 A 11/1993 Chun et al.
5,268,018 A 12/1993 Mourer et al.
5,272,718 A 12/1993 Stenzel et al.
5,291,940 A 3/1994 Borofka et al.
5,296,274 A 3/1994 Movchan et al.
5,302,881 A 4/1994 O'Loughlin
5,310,165 A 5/1994 Benz et al.
5,325,906 A 7/1994 Benz et al.
5,332,197 A 7/1994 Benz et al.
5,346,184 A 9/1994 Ghosh
5,348,566 A 9/1994 Sawyer et al.
5,366,206 A 11/1994 Sawyer et al.
5,368,897 A 11/1994 Kurihara et al.
5,377,961 A 1/1995 Smith et al.
5,378,957 A 1/1995 Kelly
5,381,847 A 1/1995 Ashok et al.
5,384,821 A 1/1995 Jedlitschka et al.
5,460,851 A 10/1995 Jenkins
5,472,177 A 12/1995 Benz et al.
5,480,097 A 1/1996 Carter, Jr. et al.
5,489,820 A 2/1996 Ivanov et al.
5,503,655 A 4/1996 Joseph
5,527,381 A 6/1996 Waite et al.
5,649,992 A 7/1997 Carter, Jr. et al.
5,649,993 A 7/1997 Carter, Jr. et al.
5,683,653 A 11/1997 Benz et al.
5,699,850 A 12/1997 Beitelman et al.
5,722,479 A 3/1998 Oeftering
5,749,938 A 5/1998 Coombs
5,749,989 A 5/1998 Linman et al.
5,769,151 A 6/1998 Carter, Jr. et al.
5,809,057 A 9/1998 Benz et al.
5,810,066 A 9/1998 Knudsen et al.
5,894,980 A 4/1999 Orme-Marmarelis et al.
5,954,112 A 9/1999 Forbes Jones et al.
5,972,282 A 10/1999 Aguirre et al.
5,985,206 A 11/1999 Zabala et al.
6,043,451 A 3/2000 Julien et al.
6,068,043 A 5/2000 Clark
6,103,182 A 8/2000 Campbell
6,135,194 A * 10/2000 Flinn et al. ..... 164/46
6,156,667 A 12/2000 Jewett
6,162,377 A 12/2000 Ghosh et al.
6,168,666 B1 1/2001 Sun
6,264,717 B1 7/2001 Carter, Jr. et al.
6,350,293 B1 2/2002 Carter, Jr. et al.
6,407,399 B1 6/2002 Livesay
6,416,564 B1 7/2002 Bond
6,427,752 B1 8/2002 Carter, Jr. et al.
6,460,595 B1 10/2002 Benz et al.
6,491,737 B2 12/2002 Orme-Marmerelis et al.
6,496,529 B1 12/2002 Jones et al.
6,562,099 B2 5/2003 Orme-Marmerelis et al.
6,613,266 B2 * 9/2003 McDonald ..... 264/338
6,631,753 B1 10/2003 Carter, Jr. et al.
6,772,961 B2 8/2004 Forbes Jones et al.
6,904,955 B2 6/2005 Jackson et al.
6,975,073 B2 12/2005 Wakalopulos
7,033,444 B1 4/2006 Komino et al.
7,114,548 B2 10/2006 Forbes Jones et al.
7,150,412 B2 12/2006 Wang et al.
7,154,932 B2 12/2006 Forbes Jones et al.
7,337,745 B1 3/2008 Komino et al.
7,374,598 B2 5/2008 Forbes Jones et al.
7,425,716 B2 9/2008 Demos et al.
7,439,188 B2 10/2008 DeOrnellas et al.
7,578,960 B2 8/2009 Forbes Jones et al.
7,798,199 B2 * 9/2010 Forbes Jones et al. ..... 164/46
7,803,211 B2 9/2010 Forbes Jones
7,803,212 B2 9/2010 Forbes Jones et al.
7,963,314 B2 * 6/2011 Forbes Jones et al. ..... 164/46
8,156,996 B2 * 4/2012 Forbes Jones et al. ..... 164/271
8,216,339 B2 7/2012 Forbes Jones et al.
2005/0173847 A1 8/2005 Blackburn et al.

| | | | |
|---|---|---|---|
| 2007/0151695 | A1 | 7/2007 | Forbes Jones et al. |
| 2008/0072707 | A1 | 3/2008 | Forbes Jones et al. |
| 2008/0115905 | A1 | 5/2008 | Forbes Jones et al. |
| 2008/0179033 | A1 | 7/2008 | Forbes Jones et al. |
| 2008/0179034 | A1 | 7/2008 | Forbes Jones et al. |
| 2008/0223174 | A1 | 9/2008 | Forbes Jones et al. |
| 2008/0237200 | A1 | 10/2008 | Forbes Jones et al. |
| 2009/0139682 | A1 | 6/2009 | Forbes Jones et al. |
| 2010/0012629 | A1 | 1/2010 | Forbes Jones et al. |
| 2010/0258262 | A1 | 10/2010 | Forbes Jones |
| 2010/0276112 | A1 | 11/2010 | Forbes Jones et al. |

FOREIGN PATENT DOCUMENTS

| | | | |
|---|---|---|---|
| DE | 3810294 | | 10/1988 |
| DE | 4011392 | B4 | 4/2004 |
| EP | 0073585 | A1 | 3/1983 |
| EP | 0095298 | A1 | 11/1983 |
| EP | 0225732 | B1 | 1/1992 |
| EP | 0486830 | A2 | 5/1992 |
| EP | 0400089 | B1 | 6/1993 |
| EP | 0428527 | B1 | 8/1996 |
| EP | 1101552 | A2 | 5/2001 |
| GB | 2203889 | A | 10/1988 |
| JP | 01-313181 | A | 12/1989 |
| JP | 01-313182 | A | 12/1989 |
| JP | 3-36205 | A | 2/1991 |
| JP | 6-246425 | | 9/1994 |
| JP | 8-506382 | A | 7/1996 |
| JP | 2001-6572 | A | 1/2001 |
| JP | 2001-212662 | A | 8/2001 |
| JP | 2002-311877 | A | 10/2002 |
| RU | 2089633 | C1 | 9/1997 |
| WO | WO 85/05489 | A1 | 12/1985 |
| WO | WO 86/00466 | A1 | 1/1986 |
| WO | WO 90/01250 | A1 | 2/1990 |
| WO | WO 97/49837 | A1 | 12/1997 |
| WO | WO 01/96028 | A1 | 12/2001 |
| WO | WO 02/40197 | A2 | 5/2002 |

OTHER PUBLICATIONS

Notice of Allowability dated Jun. 22, 2012 in U.S. Appl. No. 12/831,669.

Notice of Allowability dated Jun. 26, 2012 in U.S. Appl. No. 12/821,480.

"Electron-Beam Melting of Titanium," printed from http://www.antares.com.ua, Internet site, website accessed on Apr. 4, 2007, 6 pages.

A. J. Cohen, "Anomalous Diffusion in a Plasma Formed from the Exhaust Beam of an Electron-Bombardment Ion Thruster," published Aug. 1968.

A. Vizir, et al., "Recent Development and Applications of Electron, Ion and Plasma Sources Based on Vacuum Arc and Low Pressure Glow," IEEE Int. Conf. Plasma Sci., 2004, p. 286.

Alan Leatham, "Spray Forming: Alloys, Products, and Markets", *JOM-e*, Apr. 1999, vol. 51, No. 4, 13 pages.

ALD Vacuum Technologies: Electron Beam Melting (EB), printed from http://web.ald-vt.de/cms/vakuum-technologie/anlagen/electron-beam-melting-eb, website accessed on Aug. 25, 2009, 4 pages.

B. A. Knyazev, et al., "Pulsed Plasma Sources for the Production of Intense Ion Beams Based on "Catalytic" Resonance Ionization," 1994, 23 pages.

B. L. Fontaine, et al., "Performance Characteristics of a Long Pulse and High Average Power XeCl Discharge Laser," SPIE vol. 801, High Power Lasers, 1987, pp. 100-105.

B.Q. Li, "Solidification Processing of Materials in Magnetic Fields", JOM-e, Feb. 1998, vol. 50, No. 2, copyright held by *The Minerals, Metals & Materials Society*, 1998, 11 pages.

Bakish, R., "The Substance of Technology: Electron Beam Melting and Refining", JOM, Nov. 1998, pp. 28-30.

Cao, Wei-Di, "Solidification and Solid State Phase Transformation of Allvace® 718Plus™ Alloy", Journal of the Minerals, Metals & Materials Society, 2005, pp. 165-177.

Cobine, James Dillon, "Gaseous Conductors: Theory and Engineering Applications", Dover Publications, Inc. New York, 1958, 6 pages.

D.E. Tyler and W.G. Watson, "Nucleated Casting", Proceedings of the Third International Conference on Spray Forming, Sep. 1996, 11 pages.

E. M. Oks, et al., "Development of Plasma Cathode Electron Guns," Physics of Plasmas, vol. 6, No. 5, pp. 1649-1654, May 1999.

E.J. Lavernia and Y. Wu, "Spray Atomization and Deposition", John Wiley & Sons, 1996, pp. 311-314.

G. Sanchez, et al., "Thermal Effect of Ion Implantation with Ultra-Short Ion Beams," Surface and Coatings Technology, vol. 70, 1995, pp. 181-186.

G. Wakalopulos, "Pulsed WIP Electron Gun. Final Report—Fabrication Phase 1 × 40 cm and 1 × 70 cm Cooled WIP Electron Gun," Mar. 1979-Dec. 1980, 33 pages.

H. Tamura, et al., "A Plasma Ion Gun with Pierce Electrode," Japan J. Appl. Phys. 5, 1966, pp. 985-987.

Hasse, Rolf, "Thermodynamics of Irreversible Processes", Dover Publications, Inc., New York, 1990, 5 pages.

Kuiken, Gerard, "Thermodynamics of Irreversible Processes: Applications to Diffusion and Rheology", John Wiley & Sons, Oct. 1994, 10 pages.

L. Arif, et al., "Waves Behaviour in a High Repetition High Average Power Excimer Laser," SPIE vol. 1031 GCL—Seventh International Symposium on Gas Flow and Chemical Lasers, 1988, pp. 392-399.

L. E. Weddle, "Ion Gun Generated Electromagnetic Interference on the Scatha Satellite," published Dec. 1987, 78 pages.

L. M. Smith, et al., "Interferometric Investigation of a Cablegun Plasma Injector," IEEE Transactions on Plasma Science, vol. 28, No. 6, pp. 2272-2275, Dec. 2000.

L.A. Bertram et al., "Quantitative Simulations of a Superalloy VAR Ingot at the Macroscale", *Proceedings of the 1997 International Symposium on Liquid Metal Processing and Casting*, A. Mitchell and P. Auburtin, eds., Am. Vac. Soc., 1997, pp. 110-132.

M. L. Sentis, et al., "Parametric Studies of X-Ray Preionized Discharge XeCl Laser at Single Shot and at High Pulse Rate Frequency (1 kHz)," J. Appl. Phys., vol. 66, No. 5, Sep. 1, 1989, pp. 1925-1930.

Macky, W.A., "Some Investigations on the Deformation and Breaking of Water Drops in Strong Electric Fields", Proc. Roy. Soc. London, Series A, Jul. 2, 1931, pp. 565-587.

N. N. Semashko, et al. "Sources of Gas-Ion Beams with Current up to 60 A for Controlled Thermonuclear Fusion and Technological Applications," Atomic Energy, vol. 82, No. 1, 1997, pp. 21-27.

P. F. McKay, "Development of a Twelve-Plasma Gun, Single-Pulser Combination for Use in the PBFA-1 Hybrid Ion Diode," published Oct. 1985, 30 pages.

R. C. Olsen, et al., "Plasma Wave Observations During Ion Gun Experiments," Journal of Geophysical Research, vol. 95, No. A6, Jun. 1, 1990, pp. 7759-7771.

S. Humphries, Jr., et al., "Pulsed Plasma Guns for Intense Ion Beam Injectors," Rev. Sci. Instrum. vol. 52, No. 2, Feb. 1981, pp. 162-171.

S. Suckewer, "Spectral Measurements of Plasma Temperature in the Rod Plasma Injector (RPI)," Nukleonika, No. 1, 1970, 22 pages.

Sandia National Labs, "Particle Beam Fusion Progress Report, Jan.-Jun. 1980," published May 1981, 173 pages.

Sears, Francis Weston, An Introduction to Thermodynamics, The Kinetic Theory of Gases, and Statistical Mechanics, 2nd Edition, Addison-Wesley, 1959, pp. 335-337.

V. A. Chernov, "The Powerful High-Voltage Glow Discharge Electron Gun and Power Unit on Its Base," 1994 Intern. Conf. on Electron Beam Melting (Reno, Nevada), pp. 259-267.

V. M. Chicherov, "Density Distribution of Hydrogen in the Interior of a Coaxial Plasma Injector Prior to the Application of High Voltage to its Electrodes," Journal of Technical Physics, vol. 36, No. 6, pp. 1055-1057, 1966.

W. Clark, "Electron Gun Technology," Hughes Research Laboratories, Final Report No. N00014-72-C-0496, 92 pages, Dec. 1976.

W.T. Carter, Jr. et al. "The CMSF Process: The Spray Forming of Clean Metal", *JOM-e*, Apr. 1999, vol. 51, No. 4, 7 pages.

William T. Carter, Jr. and Robin M. Forbes-Jones, "Nucleated Casting for Land-Based Gas Turbines", *Advanced Materials & Processes*, Jul. 2002, pp. 27-29.

William T. Carter, Jr. and Robin M. Forbes-Jones, "Nucleated Casting for the Production of Large Superalloy Ingots", *JOM*, Apr. 2005, pp. 52-57.

Y. Kiwamoto, "Small Barium Rail Gun for Plasma Injection," Rev. Sci. Instrum., vol. 51. No. 3, Mar. 1980, pp. 285-287.
Tien et al., "Superalloys, Supercomposites and Superceramics", Academic Press, Inc., Dec. 1989, pp. 49, 76-84.
Ausmus, S.L. and R.A. Beall, "Electroslag Melting of Titanium Slabs", Trans. Internat., Vacuum Metallurgy Conf., Dec. 1967, pp. 675-694.
Chronister et al., "Induction Skull Melting of Titanium and Other Reactive Alloys", Journal of Metals, Sep. 1986, pp. 51-54.
Office Action dated May 15, 2012 in U.S. Appl. No. 12/055,415.
Office Action dated Dec. 21, 2007 in U.S. Appl. No. 11/232,702.
Office Action dated Jul. 18, 2008 in U.S. Appl. No. 11/232,702.
Office Action dated Dec. 12, 2008 in U.S. Appl. No. 11/232,702.
Notice of Allowance dated Apr. 13, 2009 in U.S. Appl. No. 11/232,702.
Office Action dated Mar. 11, 2009 in U.S. Appl. No. 11/933,361.
Office Action dated Nov. 10, 2009 in U.S. Appl. No. 11/933,361.
Office Action dated Feb. 13, 2009 in U.S. Appl. No. 11/841,941.
Office Action dated Oct. 1, 2009 in U.S. Appl. No. 11/841,941.
Office Action dated Jul. 12, 2010 in U.S. Appl. No. 11/841,941.
Office Action dated Jun. 28, 2007 in U.S. Appl. No. 10/913,361.
Office Action dated Sep. 26, 2007 in U.S. Appl. No. 10/913,361.
Notice of Allowance dated Jan. 14, 2008 in U.S. Appl. No. 10/913,361.
Office Action dated Dec. 19, 2002 in U.S. Appl. No. 10/158,382.
Office Action dated Jun. 3, 2003 in U.S. Appl. No. 10/158,382.
Office Action dated Mar. 18, 2004 in U.S. Appl. No. 10/158,382.
Office Action dated Dec. 29, 2004 in U.S. Appl. No. 10/158,382.
Office Action dated Aug. 25, 2005 in U.S. Appl. No. 10/158,382.
Notice of Allowance dated May 2, 2006 in U.S. Appl. No. 10/158,382.
Supplemental Notice of Allowability dated Jun. 12, 2006 in U.S. Appl. No. 10/158,382.
Supplemental Notice of Allowability dated Jun. 29, 2006 in U.S. Appl. No. 10/158,382.
Office Action dated Nov. 20, 2002 in U.S. Appl. No. 09/882,248.
Office Action dated Jan. 21, 2003 in U.S. Appl. No. 09/882,248.
Office Action dated Jul. 8, 2003 in U.S. Appl. No. 09/882,248.
Notice of Allowance dated Oct. 22, 2003 in U.S. Appl. No. 09/882,248.
Office Action dated Dec. 6, 2001 in U.S. Appl. No. 09/726,720.
Notice of Allowance dated Apr. 23, 2002 in U.S. Appl. No. 09/726,720.
Office Action dated Aug. 29, 2005 in U.S. Appl. No. 11/008,048.
Office Action dated Nov. 8, 2005 in U.S. Appl. No. 11/008,048.
Response to Rule 312 Communication dated Aug. 16, 2006 in U.S. Appl. No. 11/008,048.
Notice of Allowance dated Jun. 27, 2006 in U.S. Appl. No. 11/008,048.
Office Action dated Nov. 27, 2009 in U.S. Appl. No. 12/053,238.
Office Action dated Jun. 3, 2010 in U.S. Appl. No. 12/053,238.
Notice of Allowance dated Jul. 2, 2010 in U.S. Appl. No. 12/053,238.
Office Action dated Dec. 9, 2009 in U.S. Appl. No. 12/053,245.
Notice of Allowance dated Jun. 9, 2010 in U.S. Appl. No. 12/053,245.
Office Action dated Apr. 27, 2010 in U.S. Appl. No. 11/564,021.
Office Action dated Nov. 9, 2010 in U.S. Appl. No. 11/564,021.
Office Action dated Jan. 21, 2011 in U.S. Appl. No. 11/564,021.
Notice of Allowance dated Jun. 2, 2010 in U.S. Appl. No. 11/949,808.
Office Action dated Jun. 25, 2010 in U.S. Appl. No. 12/502,558.
Office Action dated Sep. 23, 2010 in U.S. Appl. No. 12/502,558.
Office Action dated May 2, 2011 in U.S. Appl. No. 12/502,558.
Notice of Allowance dated Jun. 22, 2011 in U.S. Appl. No. 12/502,558.
Notice of Allowance dated Feb. 13, 2012 in U.S. Appl. No. 12/502,558.
Corrected Notice of Allowability dated Jun. 12, 2012 in U.S. Appl. No. 12/502,558.
Notice of Allowance dated Jan. 3, 2011 in U.S. Appl. No. 12/861,033.
Notice of Allowance dated Feb. 17, 2011 in U.S. Appl. No. 12/861,033.
Office Action dated Jul. 14, 2011 in U.S. Appl. No. 11/978,923.
Office Action dated Oct. 20, 2011 in U.S. Appl. No. 11/978,923.
Office Action dated May 4, 2012 in U.S. Appl. No. 11/978,923.
Office Action dated Aug. 3, 2011 in U.S. Appl. No. 13/108,402.
Notice of Allowance dated Dec. 21, 2011 in U.S. Appl. No. 13/108,402.
U.S. Appl. No. 13/207,629, filed Aug. 11, 2011.
Office Action dated Dec. 14, 2011 in U.S. Appl. No. 12/831,669.
Notice of Allowance dated Mar. 9, 2012 in U.S. Appl. No. 12/831,669.
Notice of Allowance dated Apr. 12, 2012 in U.S. Appl. No. 12/821,480.

* cited by examiner (c) 2 - 3 Bar (b) 1.0 - 1.2 Bar (a) 0.2 Bar

"A" as-rolled surface
(a)

"A" polished surface
(b)

"B" polished surface

"B" as-rolled surface (b)

(a)

(c)

(b) 120 secs
1.9 bar (a) 25 secs
1.9 bar (b) 120 secs
0.5 bar (a) 25 secs
0.5 bar (a) 120 secs
Control Sample E (b) 120 secs
Control Sample E

CASTING APPARATUS AND METHOD

CROSS REFERENCE TO RELATED APPLICATIONS

The present application is a continuation application claiming priority under 35 U.S.C. §120 to U.S. patent application Ser. No. 13/108,402, filed May 16, 2011, which issued as U.S. Pat. No. 8,156,996 on Apr. 17, 2012; which application is in turn a continuation application claiming priority under 35 U.S.C. §120 to U.S. patent application Ser. No. 12/861,033, filed Aug. 23, 2010, which issued as U.S. Pat. No. 7,963,314 on Jun. 21, 2011; and which application is in turn a continuation application claiming priority under 35 U.S.C. §120 to U.S. patent application Ser. No. 11/949,808, filed Dec. 4, 2007, which issued as U.S. Pat. No. 7,798,199 on Sept. 21, 2010. The entire disclosures of U.S. patent application No. 13/108,402 and U.S. Pat. Nos. 7,798,199 and 7,963,314 are hereby incorporated by reference herein.

STATEMENT REGARDING FEDERALLY SPONSORED RESEARCH OR DEVELOPMENT

Certain of the research leading to the present invention was funded by the National Institute of Standards and Technology Advanced Technology Program (NIST ATP), Contract No. 70NANB1 H3042. The United States may have certain rights in the invention.

TECHNICAL FIELD AND INDUSTRIAL APPLICABILITY OF THE INVENTION

The present invention relates to an apparatus and a method for casting metal and metal alloys. The present invention is also directed to preforms and other articles produced by the method and/or apparatus of the present invention.

DESCRIPTION OF THE INVENTION BACKGROUND

In certain applications, components must be manufactured from large diameter metal or metal alloy preforms which are substantially free of defects. (For ease of reference, the term "metallic material" is used herein to refer collectively to unalloyed metals and to metal alloys.) One known method for producing high quality preforms is spray forming, which is generally described in, for example, U.S. Pat. Nos. 5,325,906 and 5,348,566. Spray forming is essentially a "mold less" process using gas atomization to create a spray of droplets of liquid metal from a stream of molten metal. Spray forming, however, suffers from a number of disadvantages that make its application to the formation of large diameter preforms problematic. Furthermore, an unavoidable byproduct of spray forming is overspray, wherein a portion of the metal spray misses the developing preform altogether or solidifies in flight without attaching to the preform. Average yield losses due to overspray in spray forming can be 20-30%.

Another method for producing high quality preforms is nucleated casting, which is generally described in, for example, U.S. Pat. Nos. 6,496,529 and 7,154,932. Nucleated casting is essentially a process involving using gas atomization to create a spray of droplets of liquid metal and depositing the droplet spray into a mold. In various circumstances, portions of the droplet spray, i.e., the overspray, may accumulate on a top surface of the mold. In some instances, the overspray accumulated on the mold's top surface bonds with a preform being cast within the mold. In these circumstances, the nucleated casting process may have to be stopped in order to remove the overspray, and this may result in scrapping the preform. Accordingly, there are drawbacks associated with certain known techniques in which preforms are cast from a droplet spray. Thus, a need exists for an improved apparatus and method for nucleated casting of metallic materials.

BRIEF SUMMARY OF THE INVENTION

In one form of the invention, a nucleated casting apparatus can include an atomizing nozzle configured to produce a droplet spray of a metallic material, a mold configured to receive the droplet spray and form a preform therein, and a gas injector which can limit, and possibly prevent, overspray from accumulating on the mold. In various embodiments, the gas injector can be configured to produce a gas flow which can impinge on the droplet spray to redirect the droplet spray away from a side wall of the mold. In at least one such embodiment, the gas flow can push the droplet spray into the mold, thereby reducing the amount of the droplet spray which accumulates on top of the side wall. In various embodiments, the droplet spray may be directed by the atomizing nozzle in a generally downward direction, whereas the gas flow may be directed in a generally upward direction such that the gas flow forms a physical barrier, 'curtain', or 'fence' surrounding the perimeter of the mold and biases the droplet spray to a preferred path.

The reader will appreciate the foregoing details and advantages of the present invention, as well as others, upon consideration of the following detailed description of embodiments of the invention. The reader also may comprehend such additional advantages and details of the present invention upon carrying out or using the invention.

BRIEF DESCRIPTION OF THE DRAWINGS

The features and advantages of the present invention may be better understood by reference to the accompanying drawings in which.

DETAILED DESCRIPTION OF EMBODIMENTS OF THE INVENTION

In various embodiments, the present invention includes a process for casting a metallic material, such as 100Cr6, 1% C, 1.5% Cr AISI 52100 steel, for example. The process can include melting and refining the metallic material and subsequently casting the material to create a preform by a nucleated casting technique. Melting and refining the material may be accomplished by, for example, electroslag remelting (ESR) or vacuum arc remelting (VAR). The process can also include transferring the molten refined material to a nucleated casting apparatus through a passage so as to protect it from contamination. The passage may be that formed through a cold induction guide (CIG) or another transfer apparatus. Such exemplary devices and methods are disclosed in U.S. Pat. No. 6,496,529, entitled REFINING AND CASTING APPARATUS AND METHOD, which issued on Dec. 17, 2002, U.S. Pat. No. 7,154,932, entitled REFINING AND CASTING APPARATUS, which issued on Dec. 26, 2006, and U.S. patent application Ser. No. 11/564,021, entitled REFINING AND CASTING APPARATUS AND METHOD, which was filed on Nov. 28, 2006, the disclosures of which are hereby incorporated by reference herein. Other suitable devices and methods, however, can be used to provide a molten metallic material in connection with the devices and methods described below.

Figure 1:
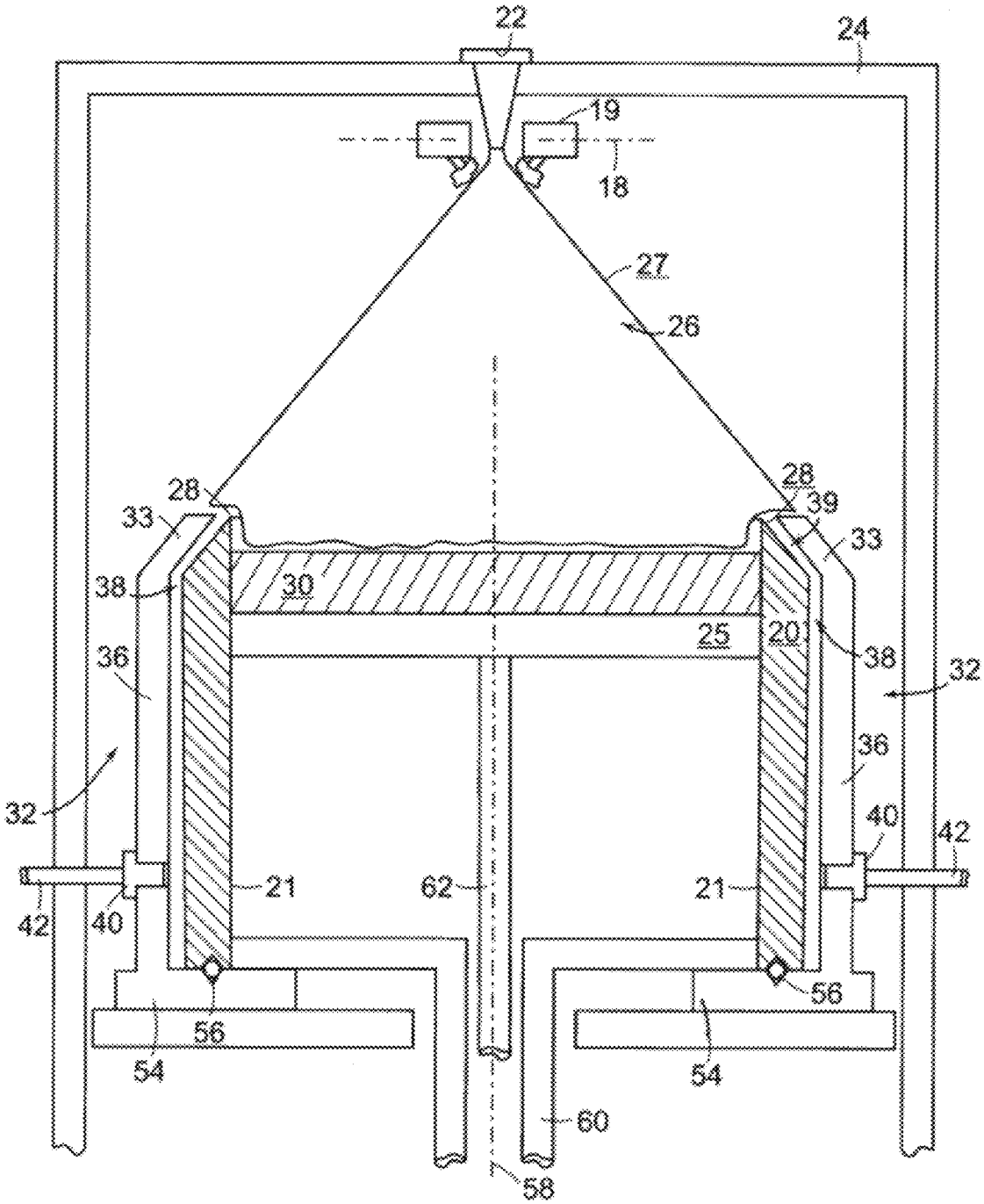
FIG. 1 is a cross-sectional view of a nucleated casting apparatus in accordance with one non-limiting embodiment of the present invention.

In various embodiments, referring to FIG. 1, a nucleated casting apparatus can include nozzle 22, atomizer 19, and mold 20 positioned within chamber 24. In use, nozzle 22 can create a stream or flow of molten metallic material which can pass through atomizer 19. In at least one embodiment, atomizer 19 can be configured to produce at least one jet of inert gas which can impinge on the stream of metallic material. In various embodiments, as a result of the above, the jet, or jets, of inert gas can break up the stream into a plurality of droplets, such as droplet spray 26, for example. To cast a preform of the metallic material, nozzle 22 and atomizer 19 can be configured to direct droplet spray 26 into mold 20. In various embodiments, atomizer 19 can be pivoted, or otherwise moved, to change the direction and/or configuration of droplet spray 26. More particularly, referring to FIG. 1, atomizer 19 can include axis 18 which can be moved between a first position in which it is substantially perpendicular to axis 58 and a second position in which axis 18 is skew or oblique with respect to axis 58. In at least one such embodiment, atomizer 19 can be oscillated over an approximately ±10 degree angle, for example.

In various circumstances, at least portions of droplet spray 26, i.e., the overspray, can accumulate on top surface 28 of mold 20. This overspray can become welded to a preform, such as preform 30, for example, being cast within mold 20 as the overspray solidifies. In such circumstances, the overspray can, as described in greater detail below, inhibit the proper formation of preform 30. In various embodiments, referring to FIGS. 1 and 2, the nucleated casting apparatus can further include at least one gas injector, such as gas injector 32, for example, which can be configured to control droplet spray 26 and limit the amount of overspray which accumulates on top surface 28, or other portions of mold 20. More particularly, gas injector 32 can be configured to direct a flow of gas, such as gas flow 34, for example, to substantially contain and/or re-direct droplet spray 26 such that it does not contact, or substantially contact, top surface 28. In at least one embodiment, referring to FIGS. 1 and 2, gas injector 32 can include plate 36 positioned adjacent to mold 20 such that passageway 38 is defined therebetween. Gas injector 32 can further include at least one manifold 40 which can be configured to place at least one gas supply line 42 in fluid communication with passageway 38 and communicate a gas into passageway 38 to create gas flow 34. This gas can include nitrogen or any suitable inert gas, for example.

Figure 2:
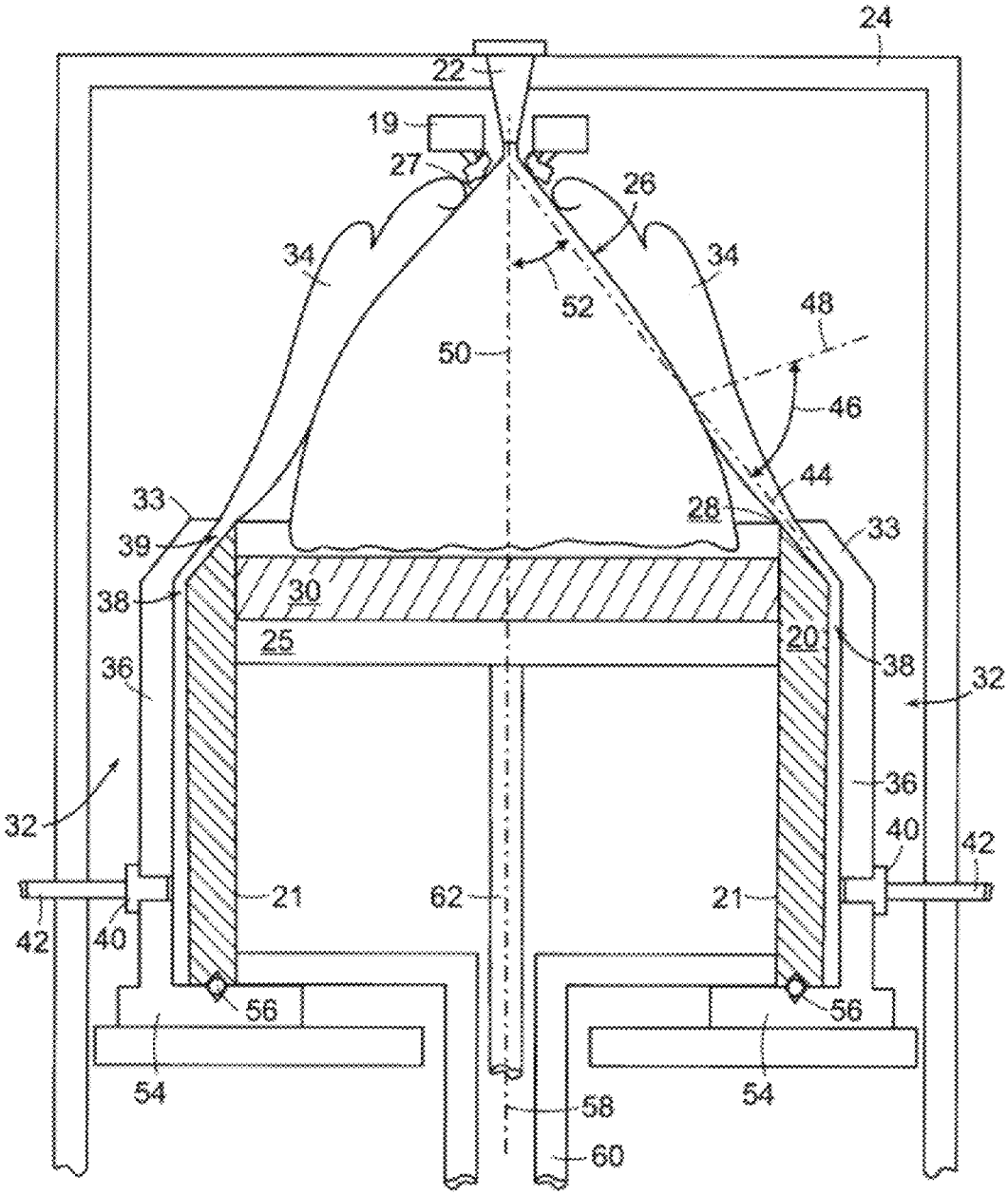
FIG. 2 is a cross-sectional view of the nucleated casting apparatus of FIG. 1 illustrating a gas injector being used to limit the accumulation of overspray on the mold.
Figure 3:
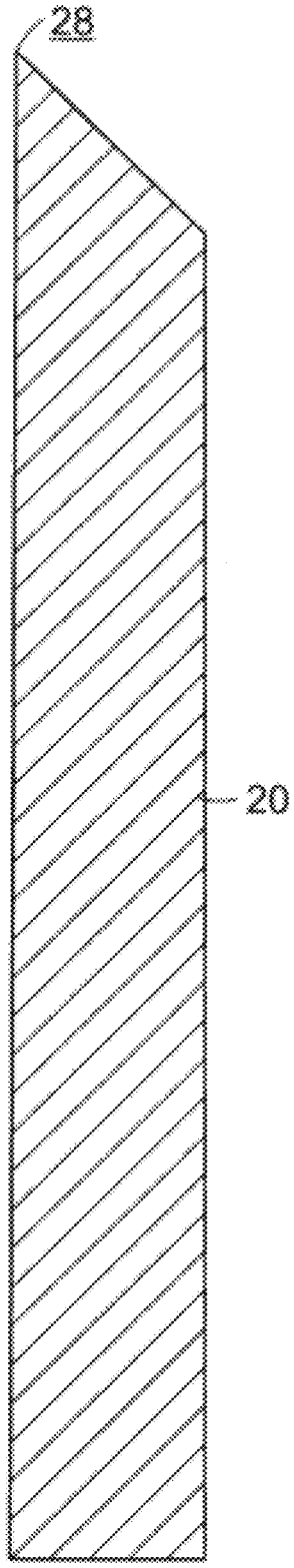
FIG. 3 is a partial cross-sectional view of the side wall of the mold of FIG. 1.

As illustrated in FIG. 2, gas flow 34 can be configured to re-direct, or push, droplet spray 26 into mold 20. In the illustrated embodiment, gas flow 34 can be configured such that it impinges on droplet spray 26 and deflects the outer perimeter of droplet spray 26 into mold 20. In at least one alternative embodiment, gas flow 34 can be configured such that it is directed parallel to the outer perimeter of droplet spray 26. In such an embodiment, gas flow 34 can act as a containment barrier or fence and can redirect the droplet spray if and when the droplet spray deviates from a desired path. In either event, as illustrated in FIG. 2, the direction of droplet spray 26 can be generally downward and the direction of gas flow 34 can be generally upward. Stated another way, the direction of droplet spray 26 can have a vertically downward component and the direction of gas flow 34 can have a vertically upward component. Other embodiments are envisioned where the droplet spray and the gas flow have oppositely directed components whether or not such components are vertical.

Referring to FIG. 2, in order to redirect droplet spray 26 into mold 20, as described above, gas flow 34 can be directed along an axis, such as axis 44, for example, which can be transverse to outer surface 27 of droplet spray 26. In these embodiments, axis 44 can define an angle of incidence 46 with normal axis 48, where normal axis 48 is perpendicular to surface 27 of droplet spray 26. In various embodiments, angle of incidence 46 can be either an acute, right or obtuse angle. In at least one embodiment, the direction of gas flow 34 can be measured with respect to a center axis of droplet spray 26, such as center axis 50, for example, and can define angle 52 therebetween. In either event, angles 46 and 52, for example, can be selected such that gas flow 34 impinges on droplet spray 26 and controls droplet spray 34 in a desired manner. Although not illustrated, gas injector 32 may be configured such that the direction of axis 44 is adjustable. In various embodiments, gas injector 32 can include a portion which can articulate with respect to mold 20. In these embodiments, the direction of gas flow 34 can be altered to accommodate variances and/or changes in the nucleated casting process, for example.

Figure 4:
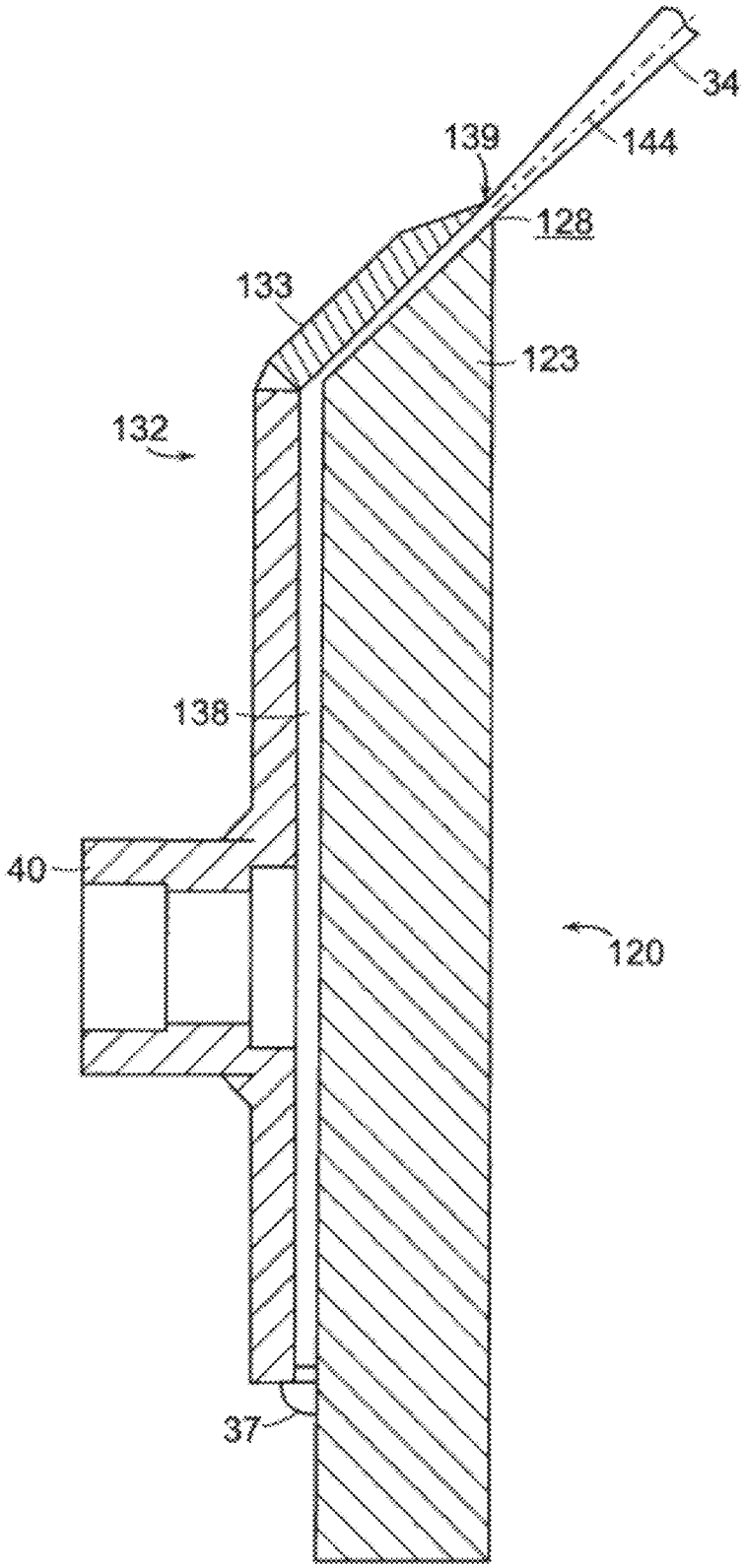
FIG. 4 is a partial cross-sectional view of a gas injector mounted to the side wall of a mold in accordance with an alternative embodiment of the present invention.
Figure 5:
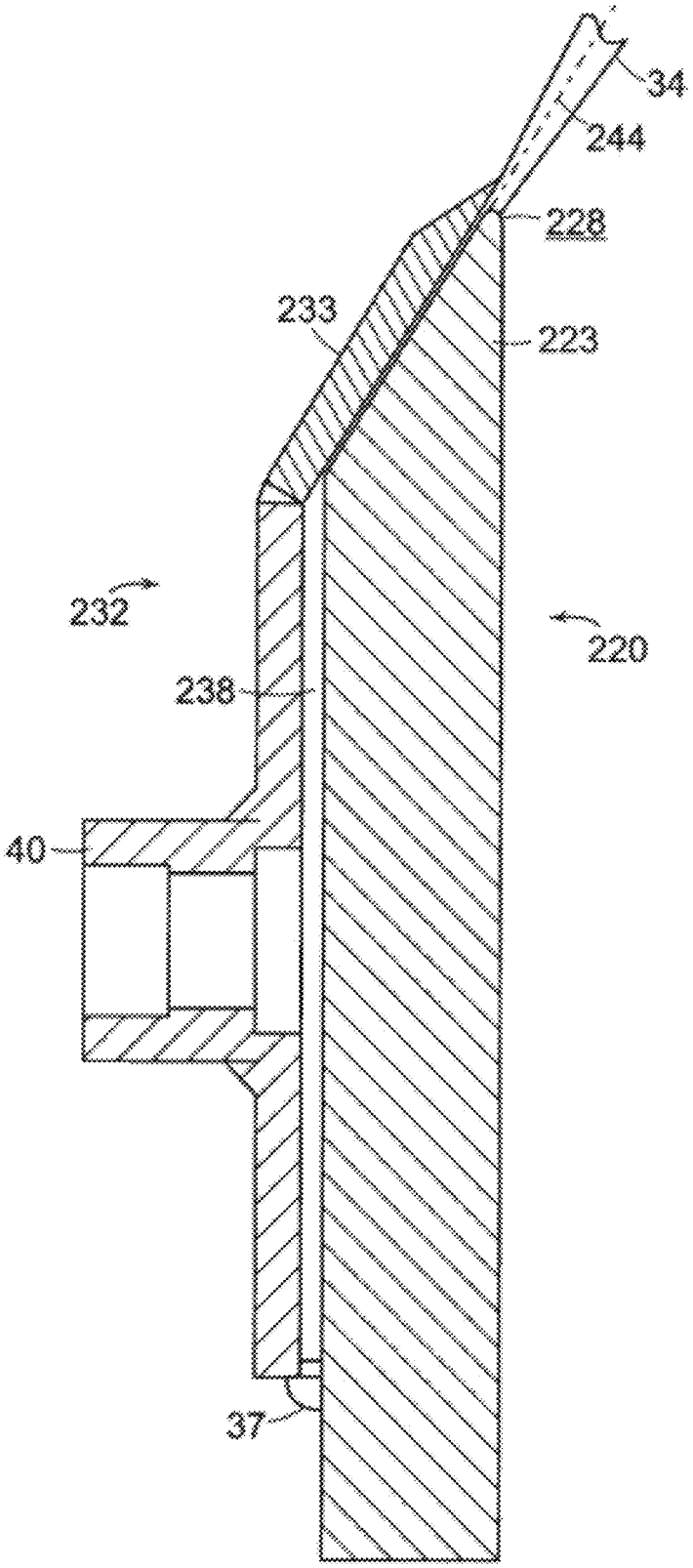
FIGS. 5-8 are partial cross-sectional views of various gas injectors and mold side walls in accordance with alternative embodiments of the present invention.
Figure 6:
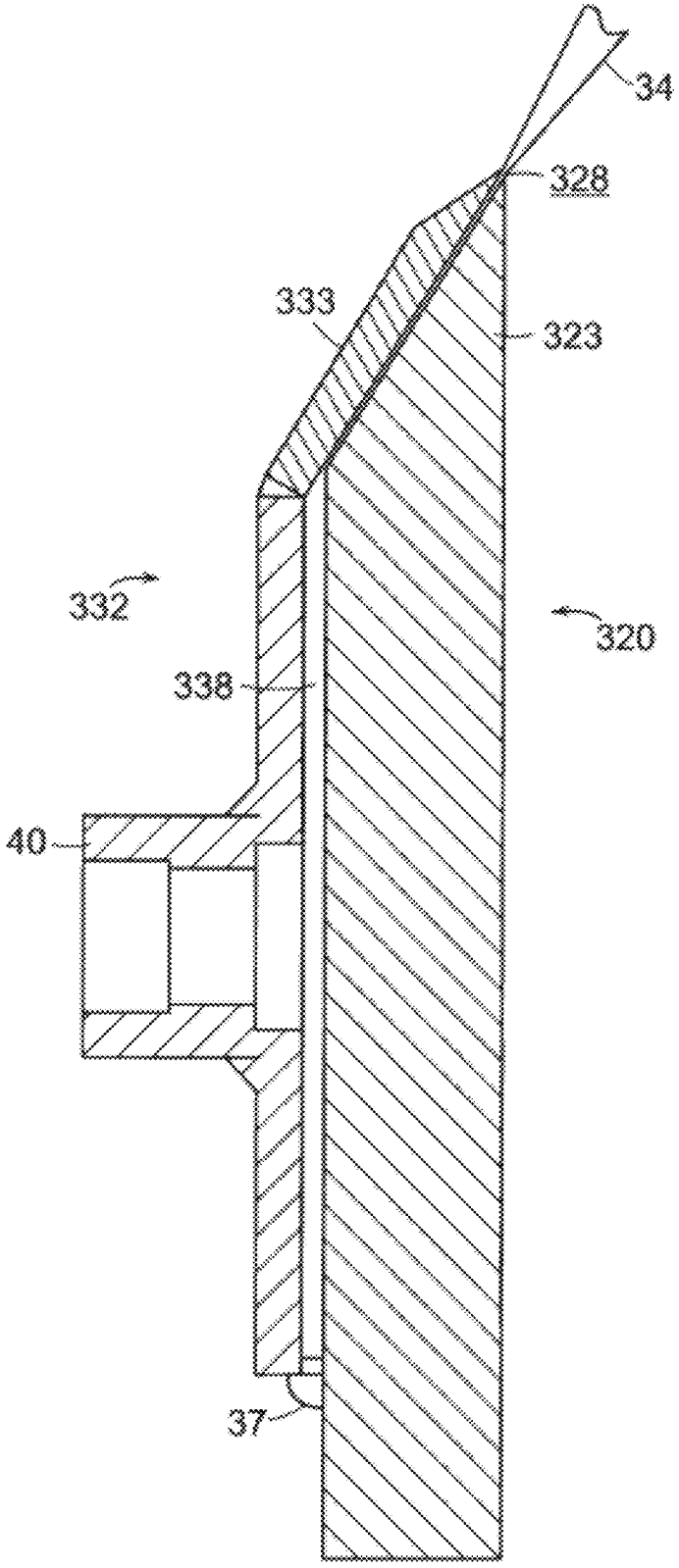
Figure 7:
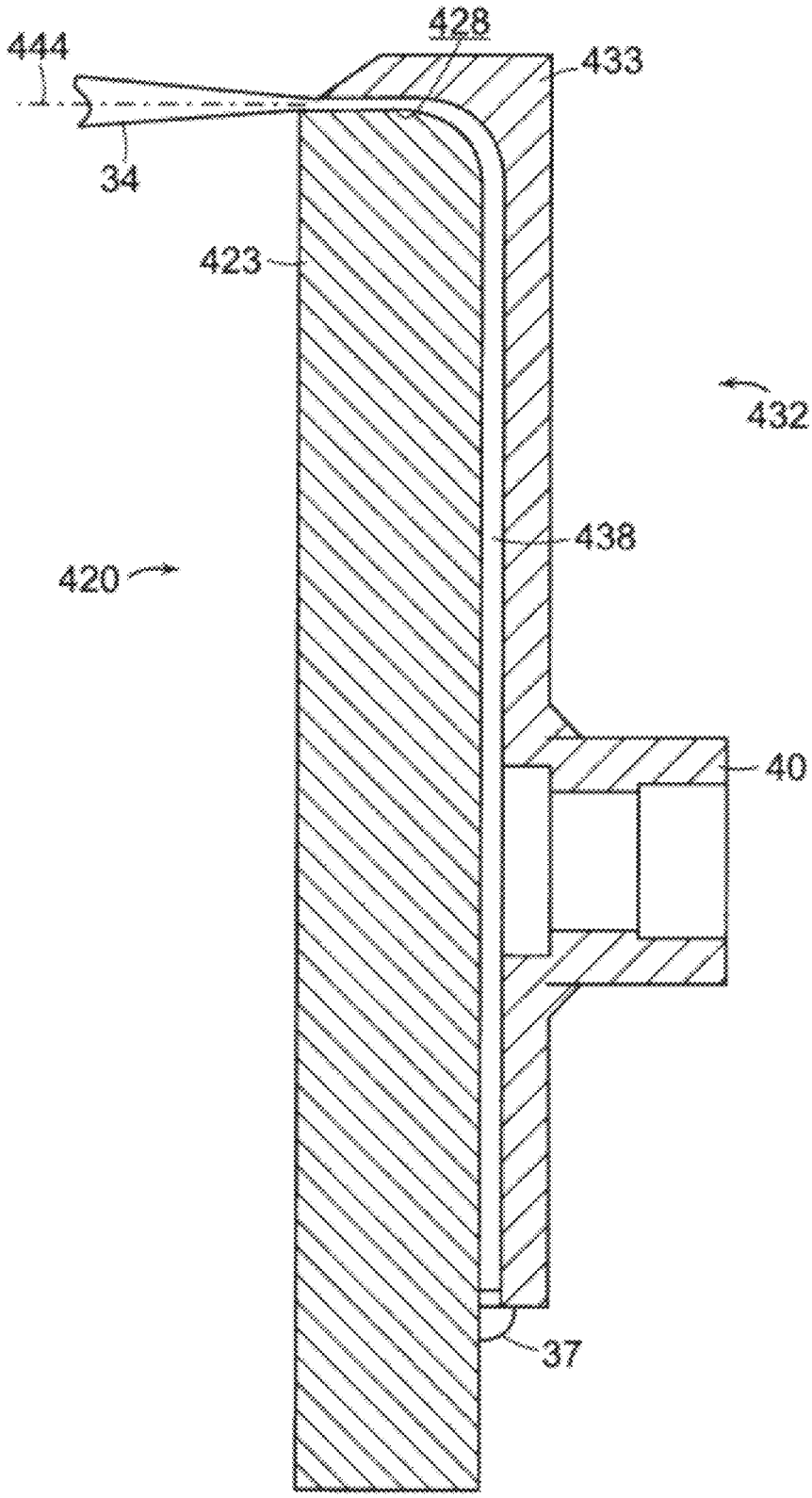
Figure 8:
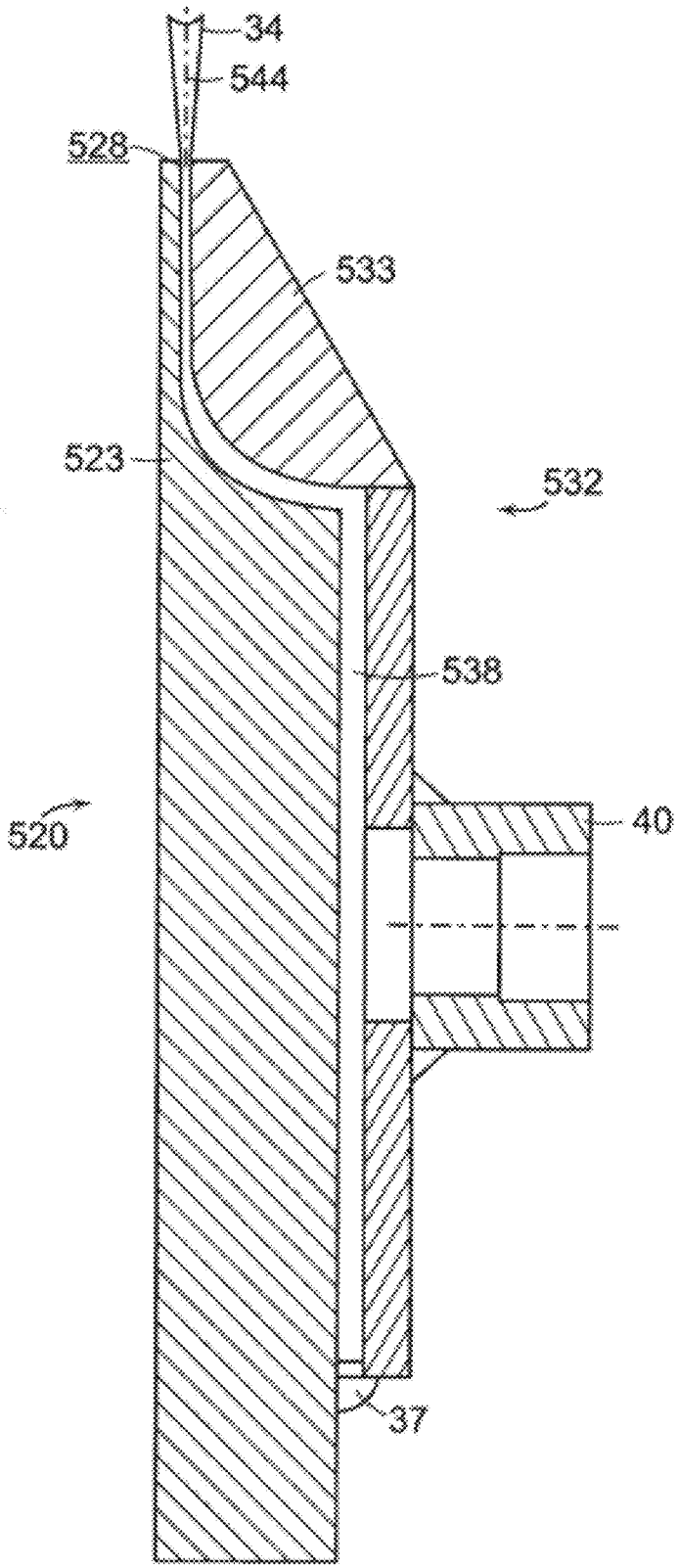

As described above and referring to FIG. 2, mold 20 and gas injector 32 can be configured to define passageway 38 therebetween. In various embodiments, referring to FIG. 4, the upper portion of mold 120, i.e., upper portion 123, and the upper portion of gas injector 132, i.e., upper portion 133, can define passageway 138 such that gas flow 34 is directed along axis 144 as described above. In at least one embodiment, upper portions 123 and 133 can be configured to define axis 144 at an approximately 45 degree angle with respect to droplet spray axis 50. In alternative embodiments, axis 144 may be defined at an angle with axis 50 which is either greater than or less than 45 degrees. Referring to FIG. 5, upper portions 223 and 233 of mold 220 and gas injector 232, respectively, can be configured to define axis 244 at an approximately 30 degree angle with respect to droplet spray axis 50, i.e., an approximately 60 degree angle with respect to the horizon in the illustrated embodiment. In at least one embodiment, at least a portion of gas injector 232 and/or mold 220 can include a radiused or rounded edge surface 228, wherein rounded edge 228 can be configured to affect the direction and profile of gas flow 34. Similarly, referring to FIG. 6, upper portions 333 and 323 of gas injector 332 and/or mold 320, respectively, can include rounded edge 328, where rounded edge 328 has a smaller radius of curvature than rounded edge 228. Referring to FIG. 7, upper portions 423 and 433 can be configured to define axis 444 in a substantially perpendicular direction to droplet spray axis 50 and, referring to FIG. 8, upper portions 523 and 533 can be configured to define axis 544 in a substantially parallel direction to droplet spray axis 50. In various embodiments, the gas injectors can be oriented to maximize the contact of the inert gas with the droplet spray and thereby minimize the deposition of overspray on the mold. In at least one embodiment, the optimum angle between the axis of the gas flow and the droplet spray can be 23 degrees, i.e., 67 degrees with respect to the horizontal.

In various embodiments, gas injector 32 and mold 20 can define passageway 38 such that it completely circumscribes, or extends around the entire perimeter of, mold 20. In at least one embodiment, passageway 38 can include one continuous opening, or gap, 39 surrounding mold 20 such that gas flow 34 exiting passageway 38 can completely circumscribe, or enclose, droplet spray 26. In such embodiments, referring to FIG. 2, the nucleated casting apparatus can include one or more gas supply lines 42 which communicate gas into passageway 38. The size and quantity of gas supply lines 42 can be selected such that the properties, i.e., density and velocity, for example, of gas flow 34 are substantially consistent around the perimeter of droplet spray 26. In alternative embodiments, passageway 38 can be configured to create a gas flow 34 which circumscribes only a portion of droplet spray 26. In various embodiments, the nucleated casting apparatus can include a plurality of passageways 38 which are not in fluid communication with each other. In such embodiments, each passageway 38 can include at least one opening 39 positioned around the perimeter of mold 20 where openings 39 can be configured to produce a desired gas flow 34.

In various embodiments, referring to FIGS. 1 and 2, the velocity of gas flow 34 exiting passageway 38 can be controlled by changing the pressure and/or volumetric flow rate of the gas supplied to passageway 38. In at least one embodiment, one or more of gas supply lines 42 can be restricted and/or completely obstructed by a valve, for example, to decrease the flow of gas to passageway 38 and thereby decrease the velocity, for example, of gas flow 34. In various embodiments, when the velocity of gas flow 34 is decreased, the capacity of gas flow 34 to redirect droplet spray 26, for example, can also be decreased. Correspondingly, the flow of gas through lines 42 can be increased to increase the capacity for gas flow 34 to redirect droplet spray 26. Such embodiments can be particularly useful in circumstances where the properties of droplet spray 26, such as size and density, for example, change during the operation of the nucleated casting process. In any event, the gas flow can be configured to have sufficient velocity to change the direction of the molten spray particles.

The following actual examples confirm advantages provided by the apparatus and method of the present invention.

EXAMPLE 1

Evaluation of Gas Injector Gap Configuration

Figure 9:
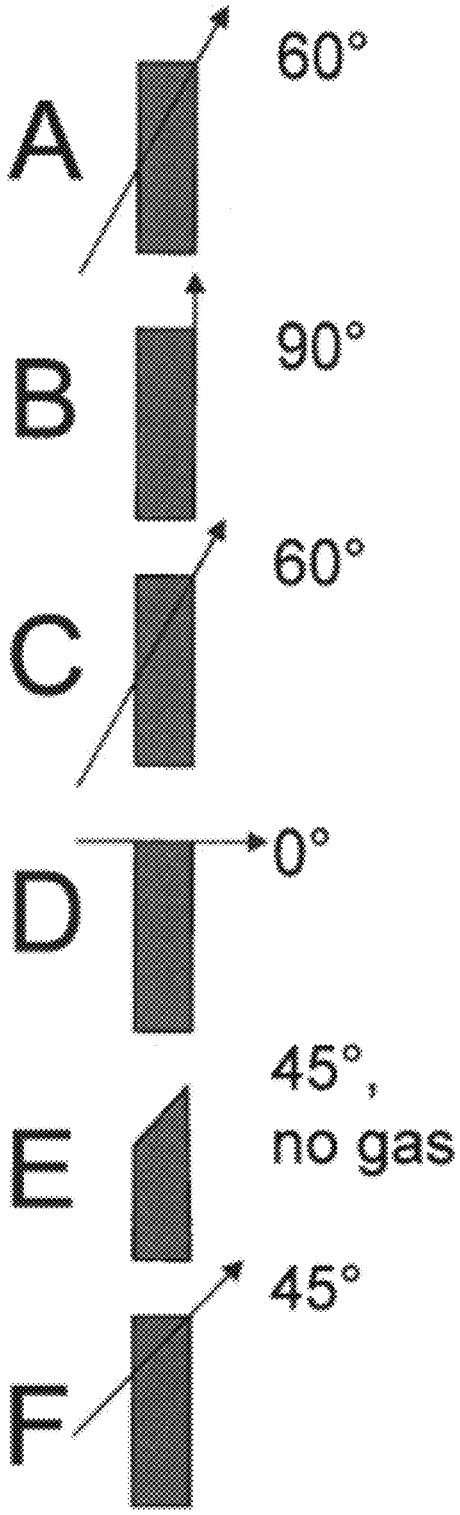
FIG. 9 is a schematic representation of Test Samples A-D and F and Control Sample E in accordance with various embodiments of the present invention.

Referring to FIG. 9, various test samples, i.e., Test Samples A-D and F, were utilized to re-direct a droplet spray of molten metallic material as described above. The test samples were then examined to compare the ability of gas injectors having different configurations to reduce the adhesion or accumulation of overspray onto the test samples. Test Sample A, referring to FIGS. 9 and 10, included a coupon which was configured to simulate at least a portion of a mold side wall and a gas injector as outlined above. Test Sample A included a vertical surface (demarcated "A" in FIG. 10), a top surface, a gap positioned intermediate the vertical surface and the top surface, and a plenum configured to place a source of inert gas in fluid communication with the gap. As depicted in FIG. 9, the gap included an axis oriented at a 60 degree angle with respect to the horizontal, i.e., at a 30 degree angle with respect to an axis of the droplet spray. In at least one evaluation, Test Sample A was utilized to redirect a droplet spray for approximately 45 seconds. As illustrated in FIG. 11, although some overspray accumulated on Test Sample A, the inert gas flow produced by Test Sample A was successful in reducing the accumulation of overspray on the top and vertical surfaces.

Figure 10:
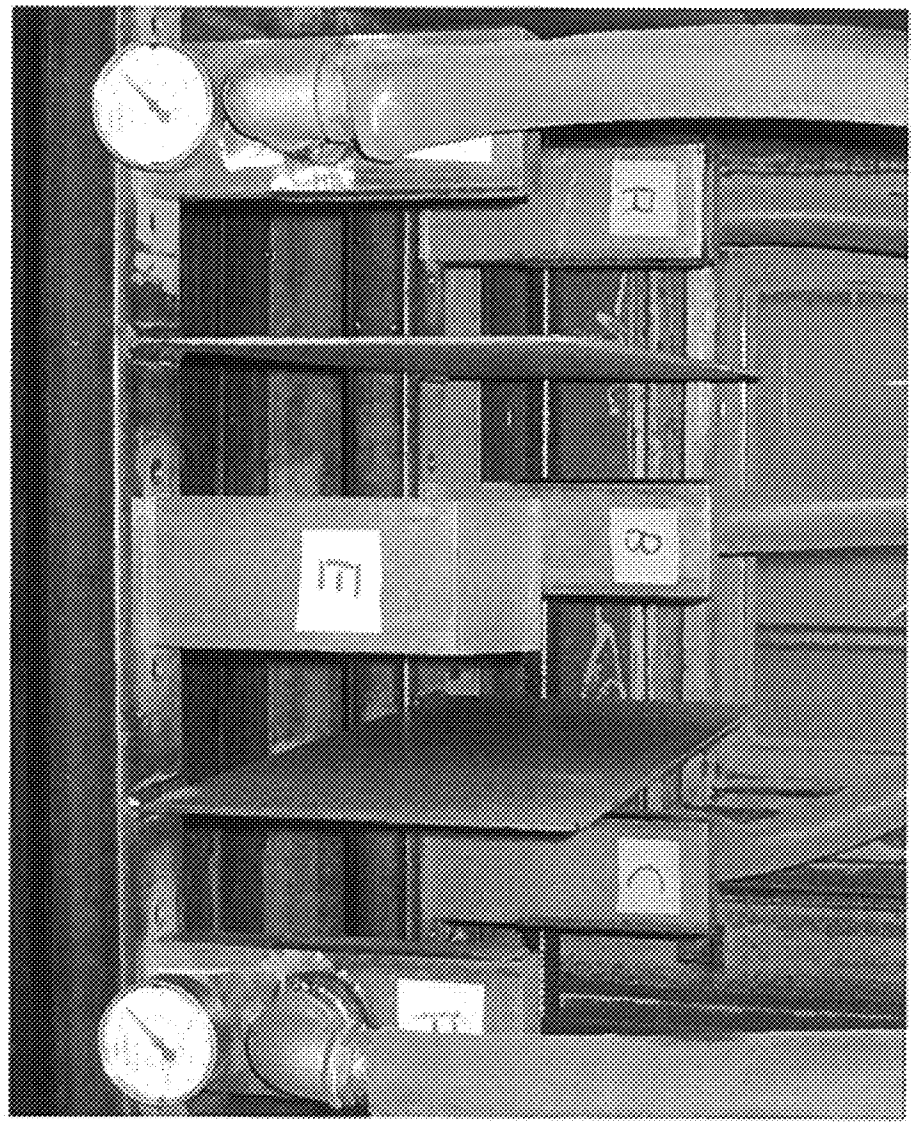
FIG. 10 is a photograph of Test Samples A-D and F in fluid communication with a source of inert gas.
Figure 11:
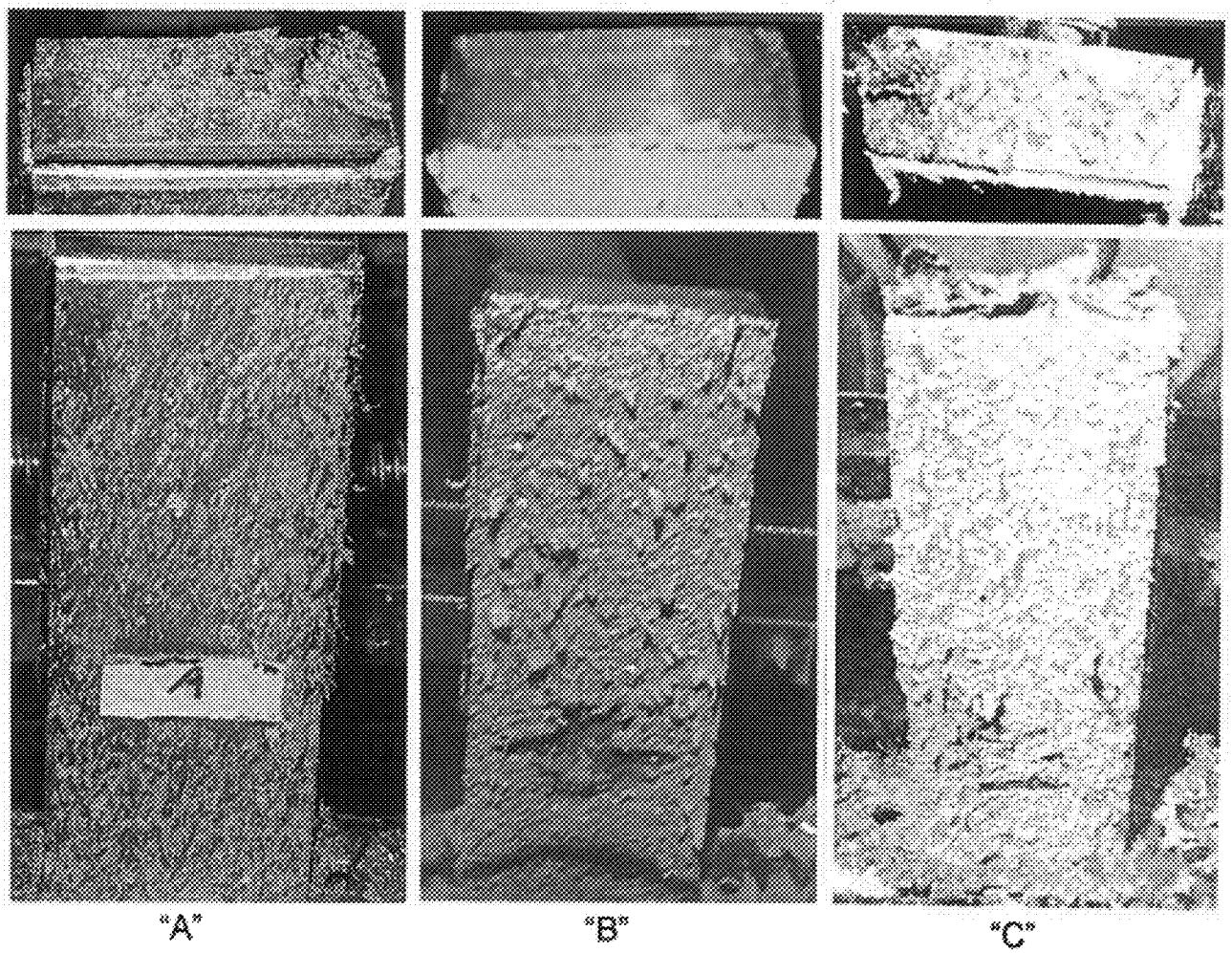
FIG. 11 includes photographs of Test Samples A-C after having been used to redirect a droplet spray of molten metallic material.
Figure 11:
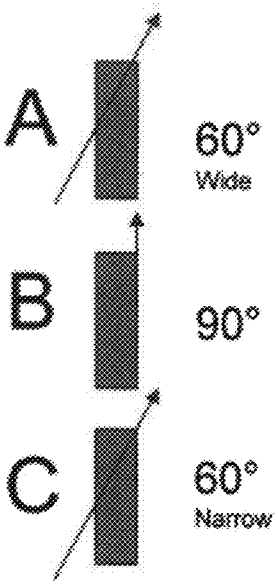
Figure 12:
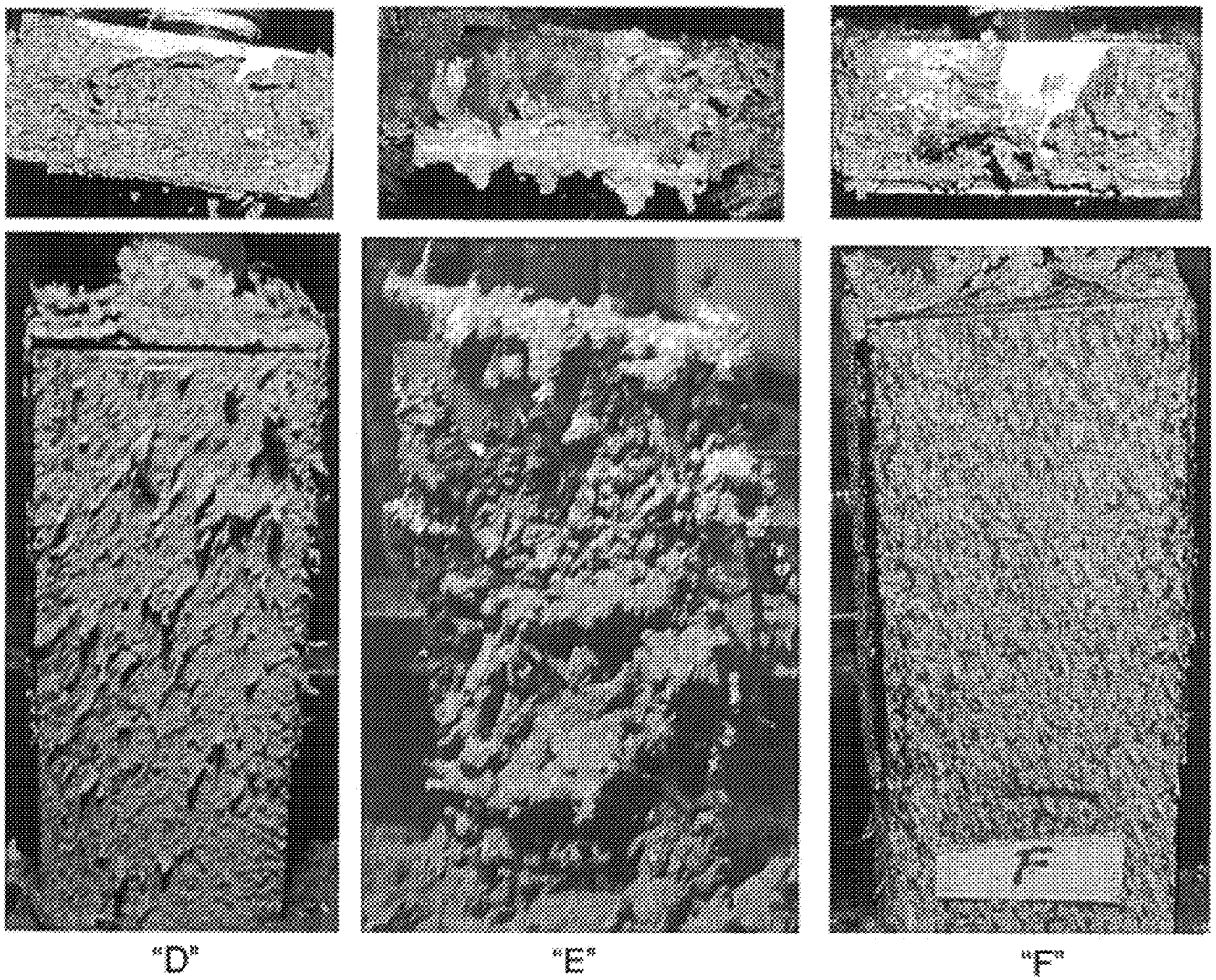
FIG. 12 includes photographs of Test Samples 0 and F after having been used to redirect a droplet spray of molten metallic material, and photographs of Control Sample E after having been exposed to a droplet spray of the molten metallic material.
Figure 12:
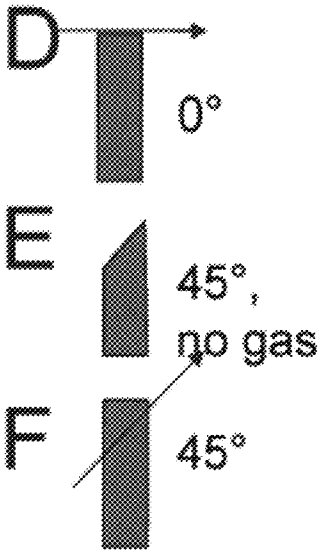

Further to the above, Test Sample B, referring to FIGS. 9 and 10, included a coupon having a gap oriented in a direction substantially parallel to the droplet spray axis. Test Sample D, again referring to FIGS. 9 and 10, included a coupon having a gap oriented in a direction substantially perpendicular to the droplet spray axis. Test Sample F included a coupon having a gap oriented at a 45 degree angle with respect to the droplet spray axis. As illustrated in FIGS. 11 and 12, Test Samples S, D, and F had varying degrees of success in preventing overspray from accumulating thereon as compared to Control Sample E. Control Sample E, referring to FIGS. 9 and 10, included a top surface oriented at a 45 degree angle relative to the axis of the droplet spray and was positioned such that the top surface was essentially facing away from the droplet spray. Referring to FIG. 12, Control Sample E, unlike Test Samples B, D, and F, did not include a gas injector and, as a result, a substantial amount of overspray accumulated thereon as compared to Test Samples B, D, and F. In fact, as illustrated in FIG. 11, the gas flow produced by Test Sample B was particularly successful in substantially preventing overspray from accumulating on the top surface of Test Sample B.

Test Sample C, similar to Test Sample A, included a gap having an axis oriented at a 60 degree angle with respect to the horizontal. As illustrated in Table 1, the thickness of the gap of Test Sample C, however, was much narrower than the gap of Test Sample A. Referring to FIG. 11, it was observed that less overspray accumulated on Test Sample A than Test Sample C. At least in view of these examples, it is apparent that a larger gap can improve the ability of a gas injector to redirect a droplet spray of molten metallic material and reduce the accumulation of overspray on the mold as compared to a narrower gap. Other samples have been evaluated where the gaps are approximately 1.5 mm and approximately 3.2 mm wherein a similar relationship was noticed. In other various examples have included gaps having a width between approximately 2.4 mm and approximately 3.2 mm.

TABLE 1

| Test Sample | A | B | C | D | F |
|---|---|---|---|---|---|
| Angle (degrees) | 60 | 90 | 60 | 0 | 45 |
| Gap (mm) | 2.6 | 1.05 | 1.25 | 1.35 | 1.3 |
| Gas Flow (kg/hr) | 420 | 240 | 235 | 295 | 340 |
| Plenum Pressure (bar) | 2 | 3 | 3 | 3 | 3 |

Figure 16:
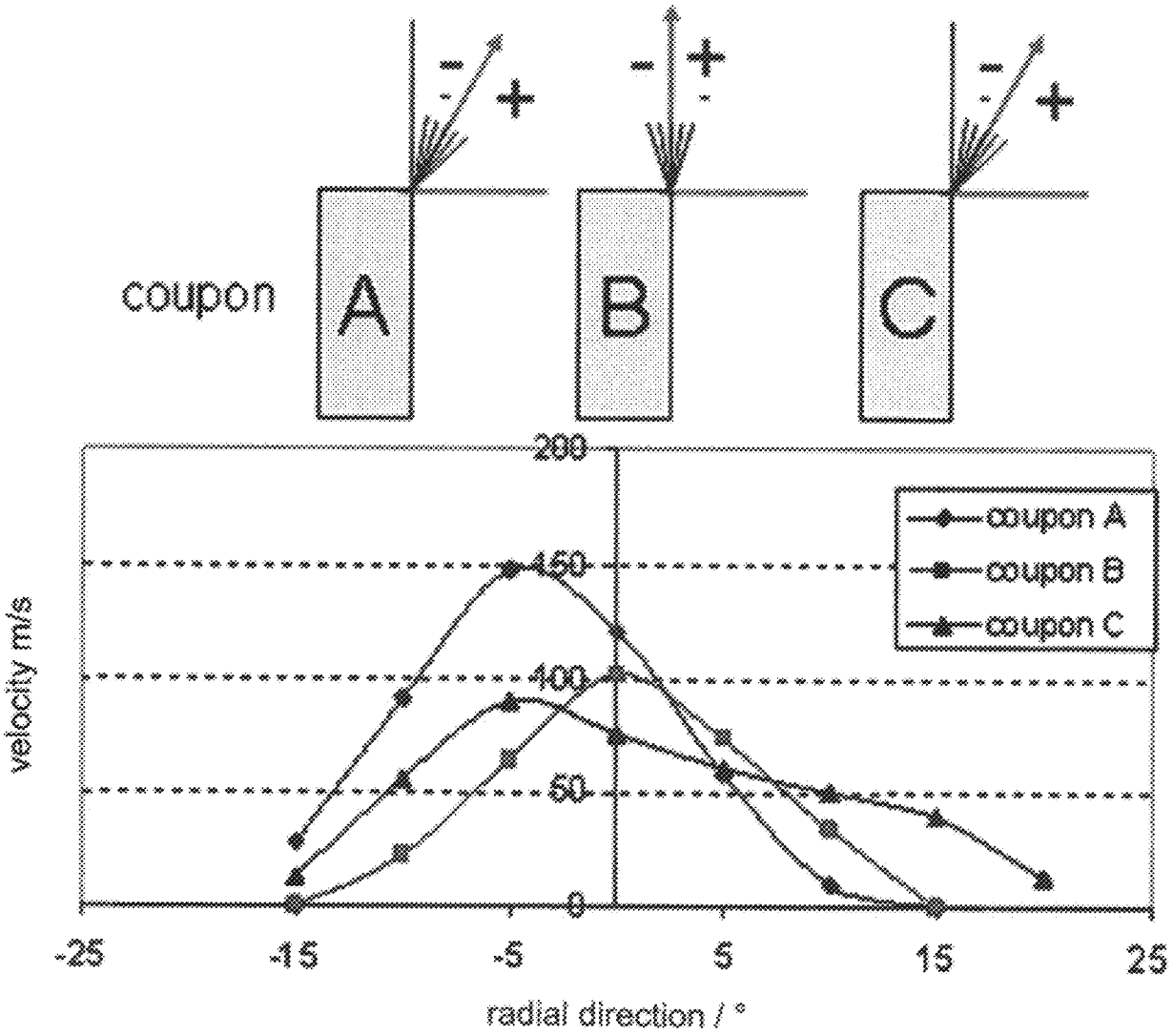
FIG. 16 includes a graph depicting the velocity profiles of gas flows exiting Test Samples A-C.

As outlined in Table 1, it was also observed that a larger gap can produce a larger and/or faster gas flow. In at least one such embodiment, a faster gas flow can impart more momentum and/or energy to the droplet spray and re-direct the droplets further away from the sidewall of the mold than a slower gas flow. In various embodiments, it was observed that, for a given test sample, the velocity of the gas exiting the gap was substantially proportional to the pressure of the inert gas within the plenum of the coupon. In at least one embodiment, the relationship between the gas velocity and pressure was linearly proportional. Furthermore, referring to FIG. 16, it was observed with respect to Test Samples A and B that the velocity of the inert gas exiting the gap included a substantially symmetrical profile. More particularly, the velocity of the inert gas was determined to be greatest along an axis wherein the velocity gradually decreased with respect to the axis. In at least one actual example, the velocity of the gas was reduced 50% when measured approximately ±7 or 8 degrees with respect to the axis. The velocity of the gas exiting the gap of Test Sample C included a substantially asymmetrical profile which may indicate that the gap included an at least partially non-symmetrical profile or was otherwise occluded.

EXAMPLE 2

Further Evaluation of Gas Injector Gap Configuration

Figure 17:
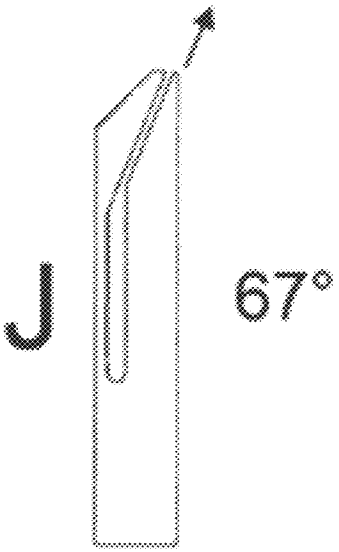
FIG. 17 is a schematic representation of Test Samples G, H, and J in accordance with various embodiments of the present invention.
Figure 17:
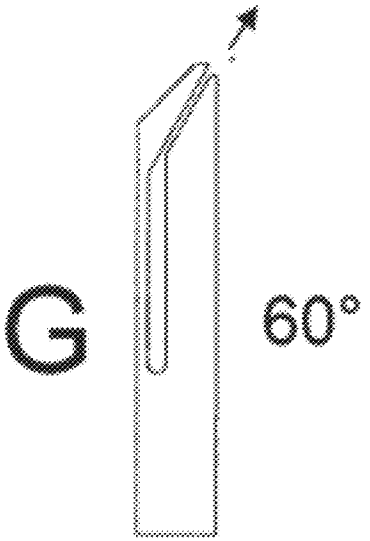
Figure 17:
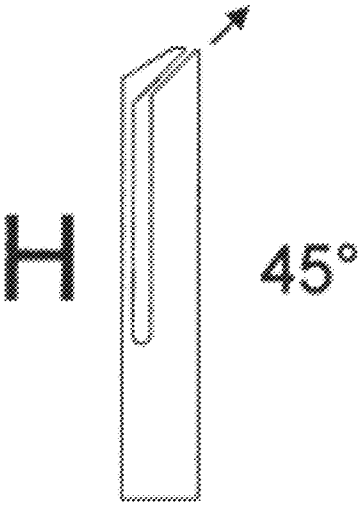

Referring to FIG. 17, various additional test samples, i.e., Test Samples G, H, and J, were also utilized to re-direct a droplet spray of molten metallic material. Similar to the above, the test samples were then examined to compare the ability of the gas injectors to reduce the adhesion or accumulation of overspray onto the test samples. Test Sample G, H, and J, similar to Test Samples A-D and F, each included a coupon which was configured to simulate at least a portion of a mold side wall and a gas injector. As depicted in FIG. 17, the gas injector of Test Sample G included a gap having an axis oriented at an approximately 60 degree angle with respect to the horizontal, i.e., at an approximately 30 degree angle with respect to an axis of the droplet spray. As also depicted in FIG. 17, Test Sample H included a gap having an approximately 45 degree axis and Test Sample J included a gap having an approximately 67 degree axis.

Figure 18:
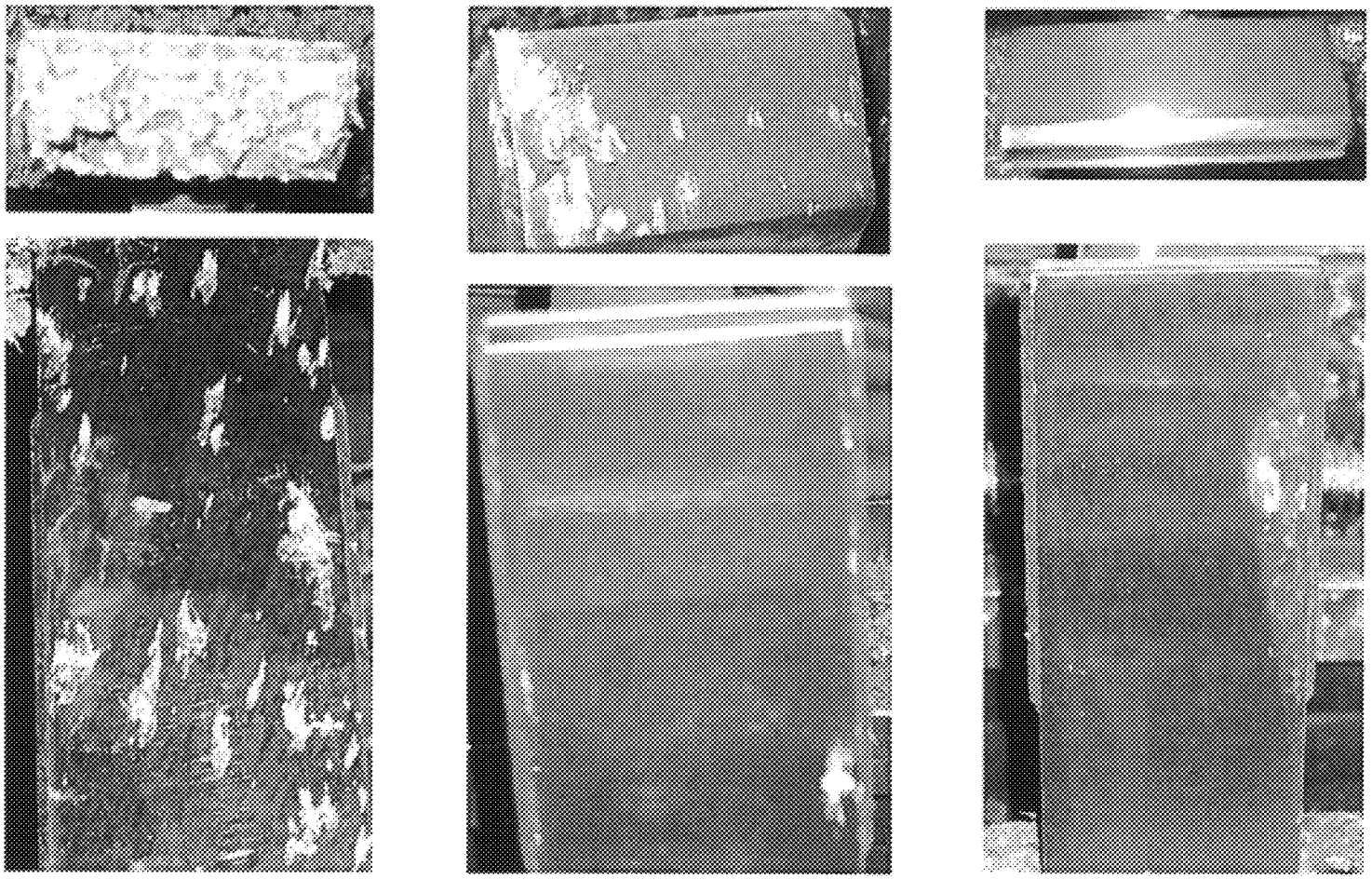
FIG. 18 includes photographs of Test Samples G, H, and J after having been used to redirect a droplet spray of molten metallic material.

In at least one evaluation, Test Samples G, H, and J were exposed to a droplet spray for approximately 25 seconds and an inert gas was supplied to the gas injectors at approximately 1.9 bar. As illustrated in FIG. 18, little, if any, overspray accumulated on Test Samples G and J while a small amount of overspray accumulated on Test Sample H. In fact, Test Sample J exhibited almost no accumulation thereon whatsoever. It is believed that such a result was related to the selection of the approximately 67 degree angle of the gap axis. More particularly, the approximately 67 degree gap axis was selected such that it substantially matched the angle of the atomized droplet spray at the edge of the mold/gas injector test sample. Such a result is further supported by the similar result exhibited with Test Sample G which included an approximately 60 degree gap axis.

While an approximately 67 degree angle was determined to be optimal for these particular test samples, the optimal angle in other embodiments may be different and may be dependent upon the distance between the nozzle and the top of the mold, the diameter of the mold, and the configuration of the droplet spray. In at least one embodiment, the droplet spray may be rastered and/or oscillated relative to the mold wherein, in such embodiments, the optimal gap axis angle may be selected based on an average and/or median configuration of the droplet spray, for example. In various circumstances, including evaluations utilizing Test Sample H, for example, the inert gas flow produced by at least one gas injector impinged on the droplet spray so significantly that it overly disrupted the spray cone and caused portions of the droplet spray to accumulate on adjacent test samples. In view of the above, it was determined that the pressure and velocity of such gas flows could be controlled, or reduced, to prevent such gas injectors from producing an overly-disruptive gas flow.

TABLE 2

| Coupon | G | H | J |
|---|---|---|---|
| Angle (degrees) | 60 | 45 | 67 |
| Gap (mm) | 2.75 | 2.75 | 2.7 |
| Plenum Pressure (bar) | 1.8 | 1.7 | 1.9 |

EXAMPLE 3

Evaluation of Inert Gas Pressure

Figure 13:
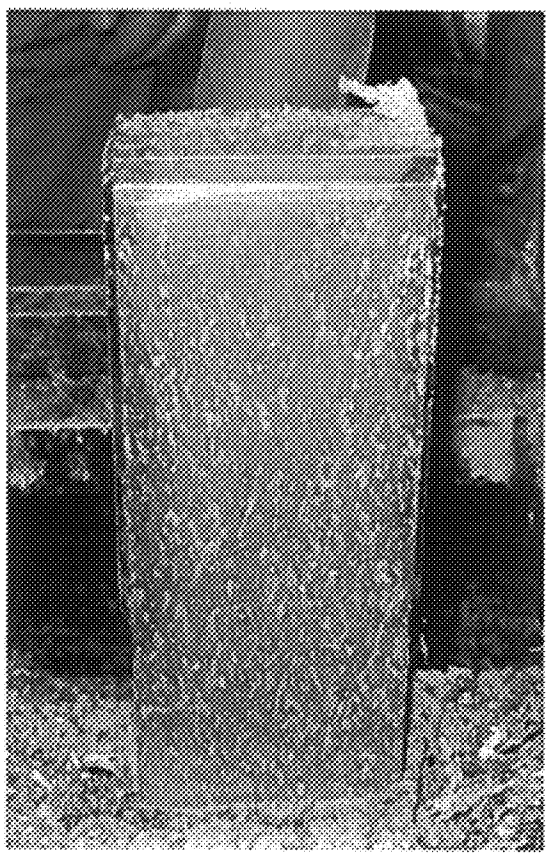
FIG. 13 includes photographs of various specimens of Test Sample A after having been used to redirect droplet sprays of molten metallic material, wherein the test samples were provided with inert gas supplies having different pressures.
Figure 13:
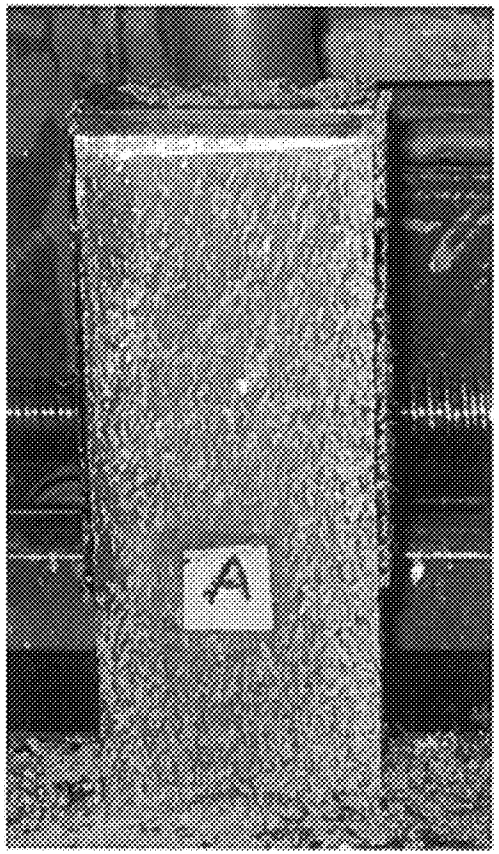
Figure 13:
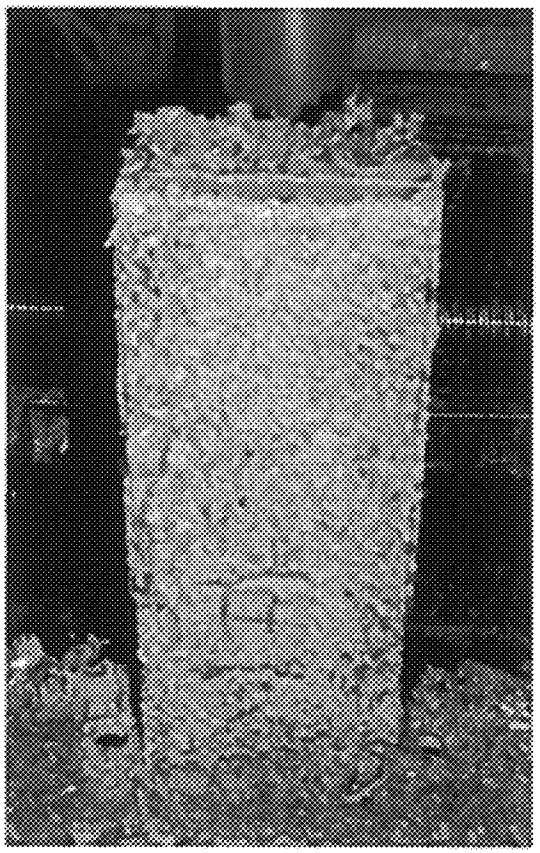

Referring to FIG. 13, various specimens of Test Sample A were utilized to re-direct a droplet spray of molten metallic material as described above. The test samples were then examined to compare the ability of various gas injectors having substantially the same configuration, but supplied with inert gas flows having different pressures, to reduce the adhesion or accumulation of overspray onto the test samples. In the first example, depicted in FIG. 13(*a*), nitrogen gas having a pressure of approximately 0.2 bar was supplied to the test sample. In the second example, depicted in FIG. 13(*b*), nitrogen gas having a pressure of approximately 1.0-1.2 bar was supplied to the second test sample and, in the third example, depicted in FIG. 13(*c*), nitrogen gas having a pressure of approximately 2-3 bar was supplied to the third test sample. As illustrated in FIG. 13, it was observed that less overspray accumulated on the third test sample (2-3 bar) than on the first (0.2 bar) and second (1.0-1.2 bar) test samples. Likewise, it was also observed that less overspray accumulated on the second test sample (1.0-1.2 bar) than the first test sample (0.2 bar). Thus, at least for these examples, it is apparent that a supply of gas having a higher pressure can produce a gas flow which can be better suited for reducing the accumulation of overspray on a mold as compared to a supply of gas having a lower pressure.

EXAMPLE 4

Further Evaluation of Inert Gas Pressure

Figure 19:
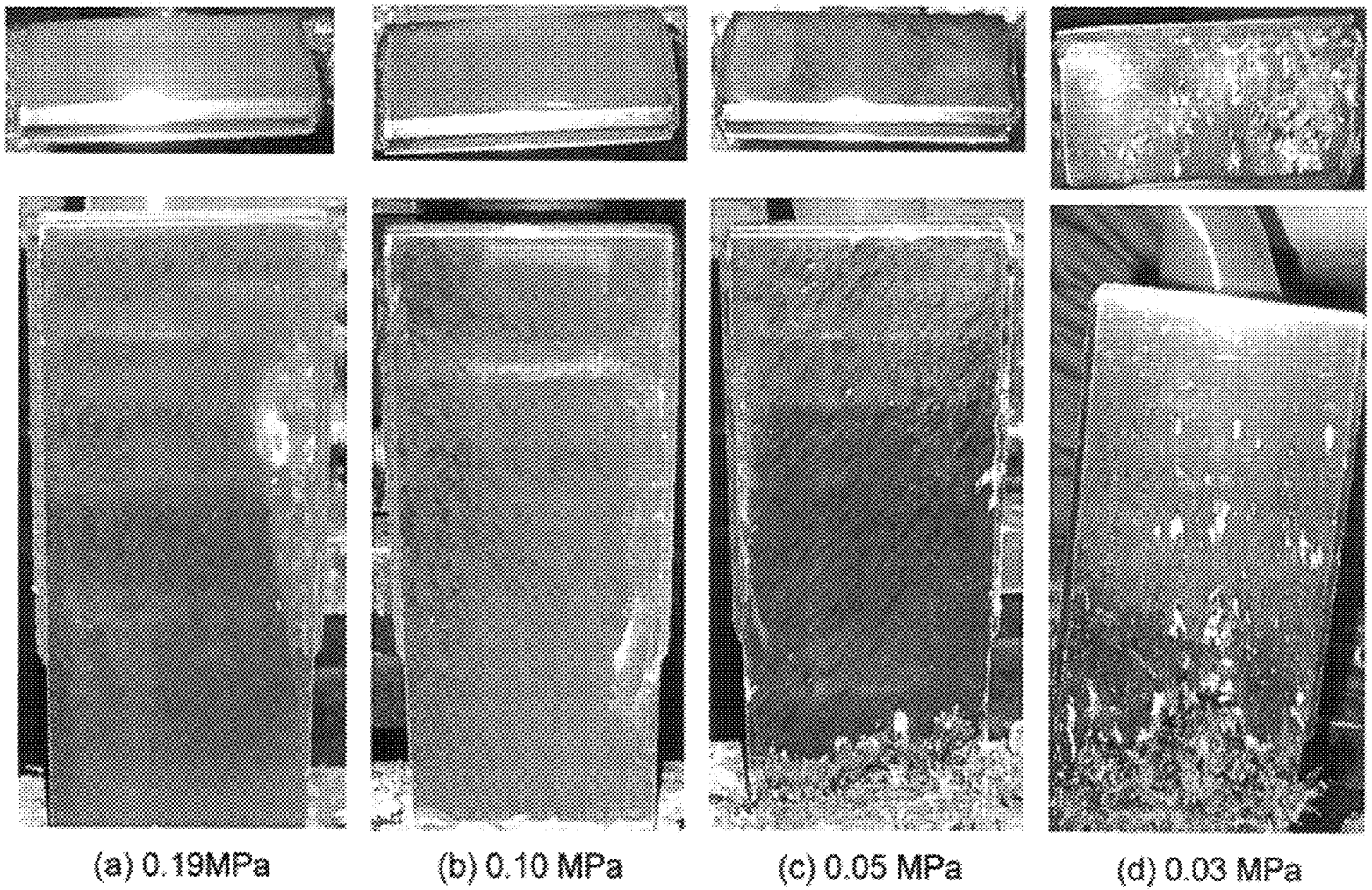
FIG. 19 includes photographs of various specimens of Test Sample J after having been used to redirect droplet sprays of molten metallic material wherein the test samples were provided with inert gas supplies having different pressures.

Referring to FIG. 19, various specimens of Test Sample J were utilized to re-direct a droplet spray of molten metallic material for approximately 25 seconds as described above. The test samples were then examined to compare the ability of various gas injectors having substantially the same configuration, but supplied with inert gas flows having different pressures, to reduce the adhesion or accumulation of overspray onto the test samples. In the first example, depicted in FIG. 19(*a*), nitrogen gas having a pressure of approximately 1.9 bar (0.19 MPa) was supplied to a first test sample. In the second example, depicted in FIG. 19(*b*), nitrogen gas having a pressure of approximately 1.0 bar (0.10 MPa) was supplied to a second test sample; in the third example, depicted in FIG. 19(*c*), nitrogen gas having a pressure of approximately 0.5 bar (0.05 MPa) was supplied to a third test sample; and, in the fourth example, depicted in FIG. 19(*d*), nitrogen gas having a pressure of approximately 0.3 bar (0.03 MPa) was supplied to a fourth test sample. As illustrated in FIG. 19, it was observed that less overspray accumulated on the first test sample (1.9 bar) than on the other test samples which were supplied with a nitrogen gas having a lower pressure. Likewise, it was also observed that less overspray accumulated on the second test sample (1.0 bar) than the third test sample (0.5 bar) and the fourth test sample (0.3 bar). Thus, at least for these additional examples, it is also apparent that a supply of gas having a higher pressure can produce a gas flow which can be better suited for reducing the accumulation of overspray on a mold as compared to a supply of gas having a lower pressure.

EXAMPLE 5

Evaluation of Surface Finishes

Figure 14:
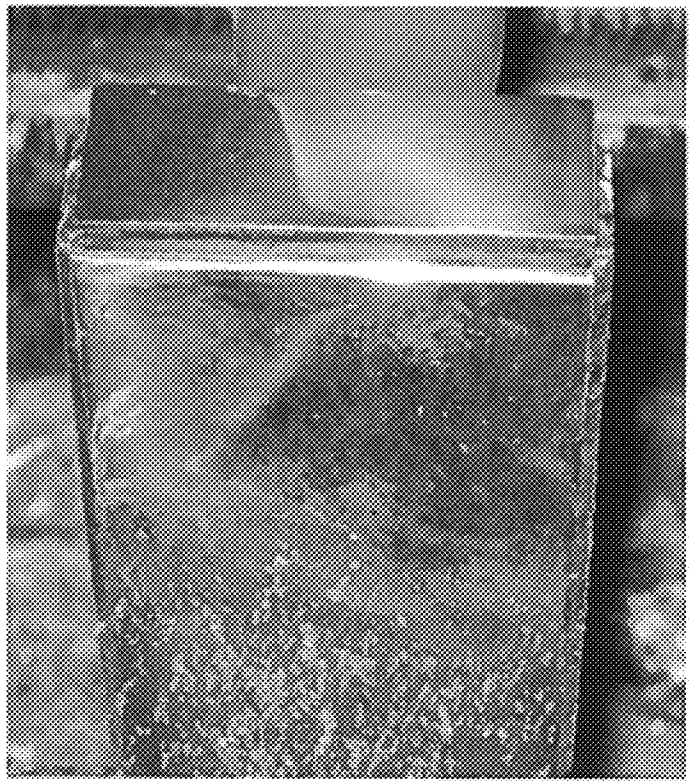
FIG. 14 includes photographs of various specimens of Test Sample A after having been used to redirect droplet sprays of molten metallic material, wherein one of the test samples includes polished surfaces.
Figure 14:
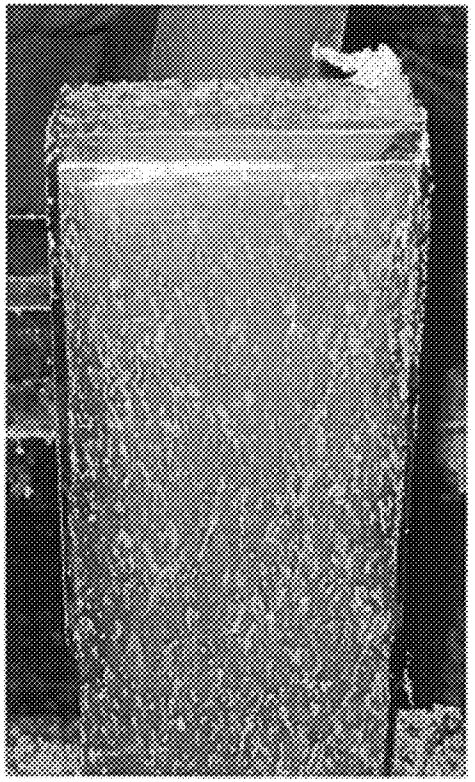
Figure 14:
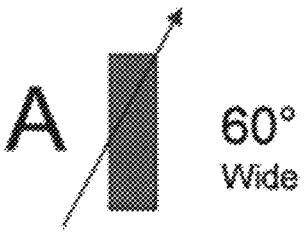

Referring to FIG. 14, various specimens of Test Sample A were utilized to re-direct a droplet spray of a molten metallic material as described above. The test samples were then examined to compare the ability of various gas injectors having substantially the same configuration, but different surface finishes, to reduce the adhesion or accumulation of overspray onto the test samples. Referring to FIG. 14(*a*), at least the vertical and top surfaces of the first specimen were comprised of 1018 cold-rolled steel which were left in a 'as-rolled' condition, i.e., they were not polished for the purposes of this example. Referring to FIG. 14(*b*), at least the vertical and top surfaces of the second specimen were also comprised of 1018 cold-rolled steel; however, the top surface and at least the upper portion of the vertical surface were polished. Generally, in various embodiments, such surfaces can be polished such that they posses a surface roughness, either Ra and/or Rq, of approximately 1 micrometer (μm). In other various embodiments, the surfaces can be polished such that they have a surface roughness, either Ra and/or Rq, of approximately 1.9 μm, approximately 0.8 μm, approximately 0.4 μm, approximately 0.1 μm, and/or approximately 0.012 μm, for example.

In various embodiments, a gas injector, or at least a portion thereof, can be polished with a surface grinder or drill, where the surface grinder or drill can include a rotating wheel configured to be moved over the surfaces of the gas injector. In such embodiments, a rotating wheel comprised of large grit particles, such as 80 grit, for example, can be initially used and, thereafter, wheels having smaller grit particles, such as 240 grit, for example, can be successively used until a 'soft wheel' is used. In at least one embodiment, the gas injector can be positioned against a rotating wheel extending from a stationary machine. In either event, the surfaces of the gas injector can then be wet polished with a rotating wheel and/or a fine polishing media. In various circumstances, the surfaces can also be manually polished with a natural brush and at least one polishing paste in order to attain the desired surface finish. In various embodiments, the gas injectors can be electro and/or chemical polished in addition to or in lieu of the mechanical polishing described above. In such embodiments, the surfaces can be polished such that they have a surface roughness, either Ra and/or Rq, of approximately 1.9 μm, approximately 0.8 μm, approximately 0.4 μm, approximately 0.1 μm, and/or approximately 0.012 μm, for example.

Figure 15:
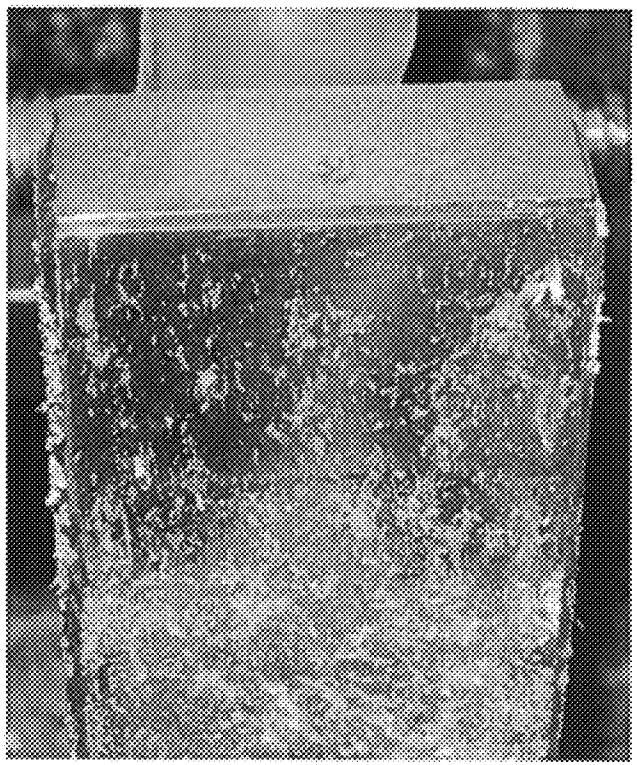
FIG. 15 includes photographs of various specimens of Test Sample B after having been used to redirect droplet sprays of molten metallic material, wherein one of the test samples includes polished surfaces.
Figure 15:
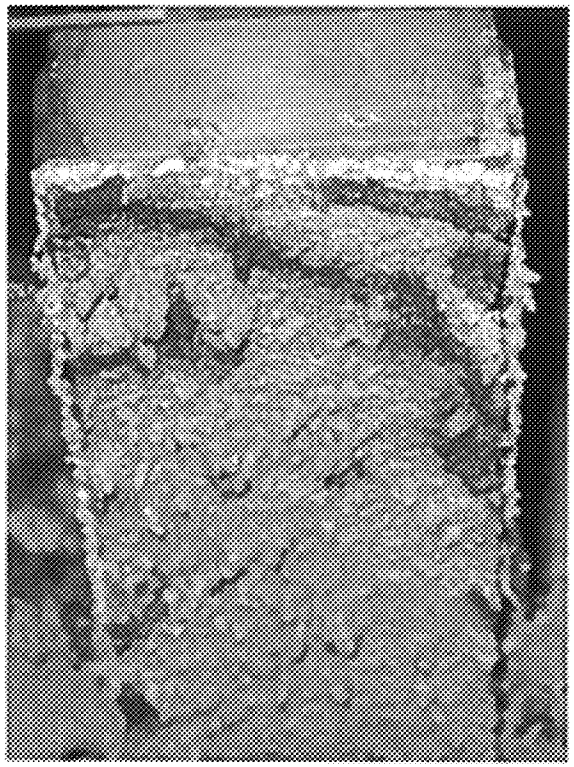
Figure 15:
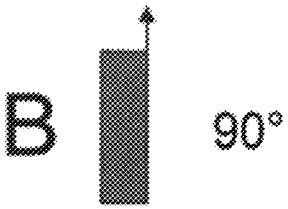

As illustrated in FIG. 14, it was observed that significantly less overspray accumulated on the polished portions of the second specimen as compared to the first specimen (FIG. 14(*a*)) and the unpolished portions of the second specimen (FIG. 14(*b*)). Similarly, referring to FIG. 15, various specimens of Test Sample B having substantially the same configuration, but different surface finishes, were utilized to redirect a droplet spray of a molten metallic material as described above. As illustrated in FIG. 15, it was observed that significantly less overspray accumulated on the polished portions of the second specimen (FIG. 15(*b*)) as compared to the first specimen (FIG. 15(*a*)) and the unpolished portions of the second specimen (FIG. 15(*b*)).

Figure 20:
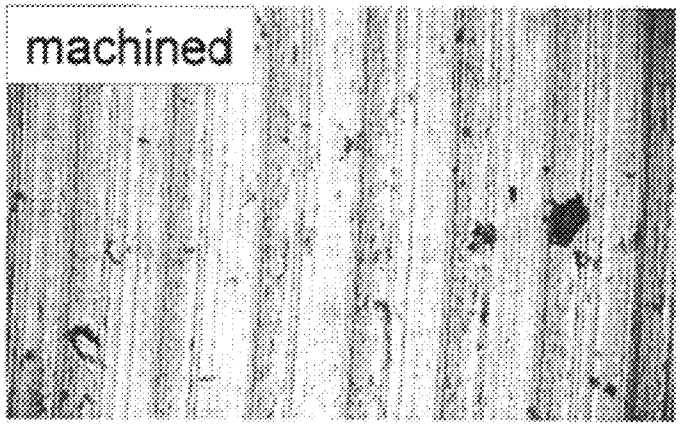
FIG. 20 includes photomicrographs of the surface roughness of various specimens of Test Sample J.
Figure 20:
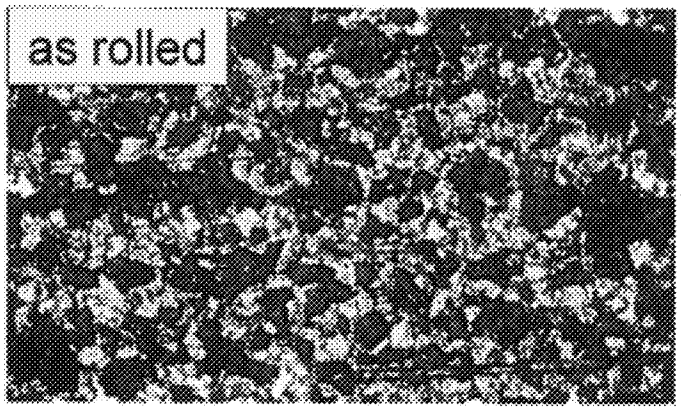
Figure 20:
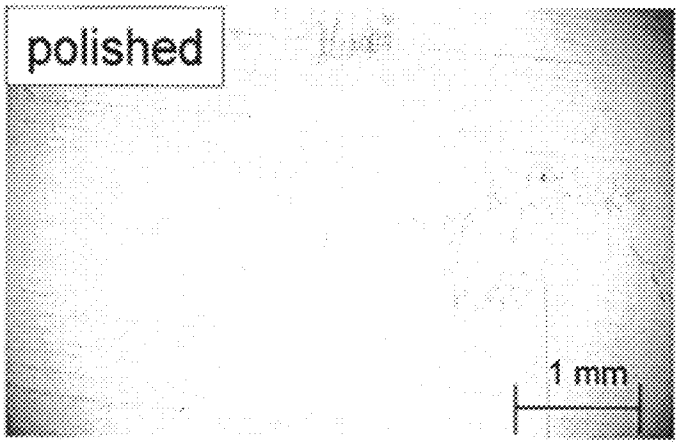

In various examples, referring to the photomicrographs illustrated in FIG. 20, the surface roughness of gas injectors having "as rolled" surfaces (FIG. 20(*a*)), machined or ground surfaces (FIG. 20(*b*)), and polished surfaces (FIG. 20(*c*)) were measured and several commonly-used statistical values were calculated using techniques described in ISO standard 4287. For example, the Roughness Average (Ra), the Determined Roughness (Rz), the Root Mean Square Roughness (Rq), the Maximum Profile Peak Height (Rp), and the Maximum Height of the Profile (Rt) of the as-rolled, ground, and polished surfaces were measured. Such values are well understood and commonly used in the field of surface metrology and, as a result, no additional description of the methods used and the calculations performed to obtain these values is provided herein.

TABLE 3

(all values in micrometers (μm))

| Surface Finish | Ra | Rz | Rq | Rp | Rt |
|---|---|---|---|---|---|
| As-rolled | 4.15 | 28.12 | 5.70 | 9.62 | 35.57 |
| Machined/Ground | 3.39 | 13.44 | 3.82 | 7.02 | 16.04 |
| Polished | 1.05 | 0.24 | 0.06 | 0.14 | 0.36 |

As can be seen from Table 3, the polished surfaces exhibited the smoothest, or least rough, surfaces and the as-rolled surfaces exhibited the roughest surfaces. As described above, droplet overspray was observed to be less likely to accumulate on gas injectors having polished surfaces than gas injectors having non-polished surfaces. Furthermore, grinding or machining the surfaces of the gas injectors and/or mold side walls can reduce the roughness of the surfaces as compared to as-rolled surfaces. In such embodiments, as a result, the ground or machined surfaces can reduce the amount of overspray which accumulates thereon as compared to as-rolled surfaces. In such embodiments, the surfaces can be machined or ground such that they have a surface roughness, either Ra and/or Rq, of approximately 6.3 μm, approximately 3.2 μm, approximately 1.6 μm, approximately 0.2 μm, approximately 0.1 μm, approximately 0.05 μm, and/or approximately 0.025 μm, for example.

In view of the above, it is believed that the tendency for the atomized droplets of metallic materials to accumulate on the as-rolled surfaces, for example, may be the result of, at least in part, a mechanical keying effect or interlocking between the atomized spray droplets and ridges extending from the as-rolled surfaces. While such a mechanical interlocking may occur on the machined and/or polished surfaces, it is believed that such surfaces have smaller and/or fewer ridges and, as a result, the atomized droplets are less likely to adhere to such surfaces. In various embodiments, further to the above, at least a portion of a gas injector and/or mold wall can be coated with a material which can decrease the coefficient of friction between the overspray droplets and the surfaces of the gas injector or mold thereby increasing the possibility that the droplets will not 'catch' on the surfaces thereof.

EXAMPLE 6

Evaluation of Operating Duration

Figure 21:
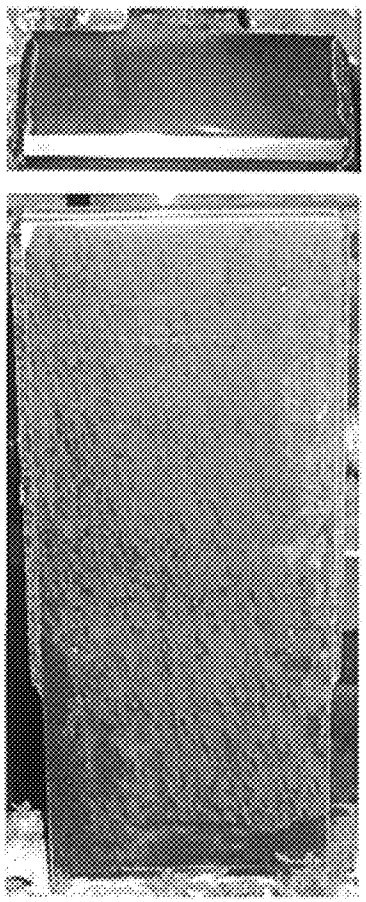
FIG. 21 includes photographs of various specimens of Test Sample J after having been used to redirect droplet sprays of molten metallic material, wherein the test samples were exposed to the droplet spray for different lengths of time.
Figure 21:
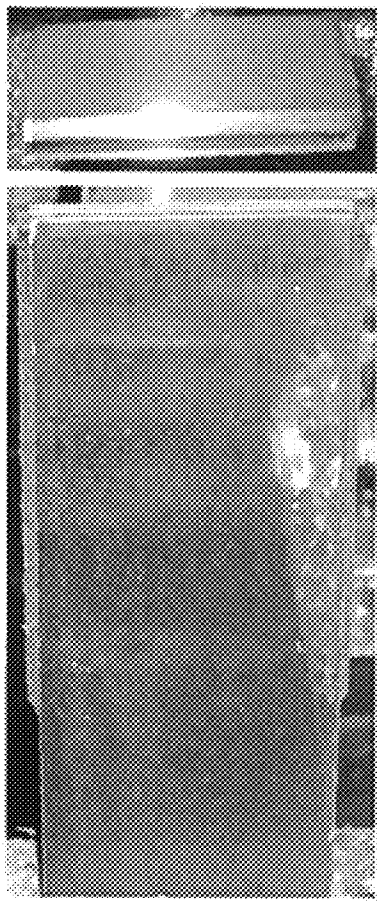
Figure 22:
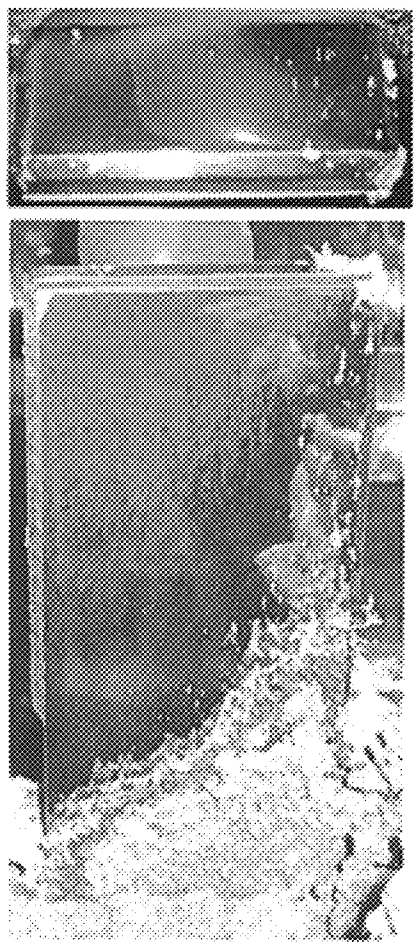
FIG. 22 includes photographs of additional specimens of Test Sample J after having been used to redirect droplet sprays of molten metallic material, wherein the test samples were exposed to the droplet spray for different lengths of time.
Figure 22:
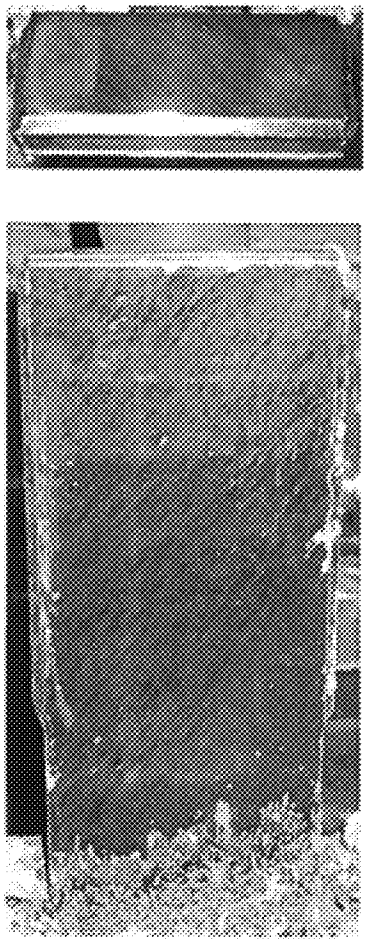
Figure 23:
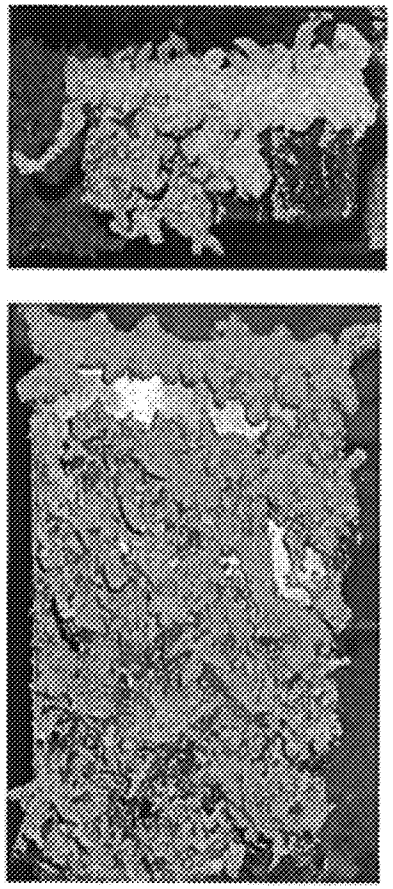
FIG. 23 includes photographs of Control Samples E after having been exposed to a droplet spray of a molten metallic material.
Figure 23:
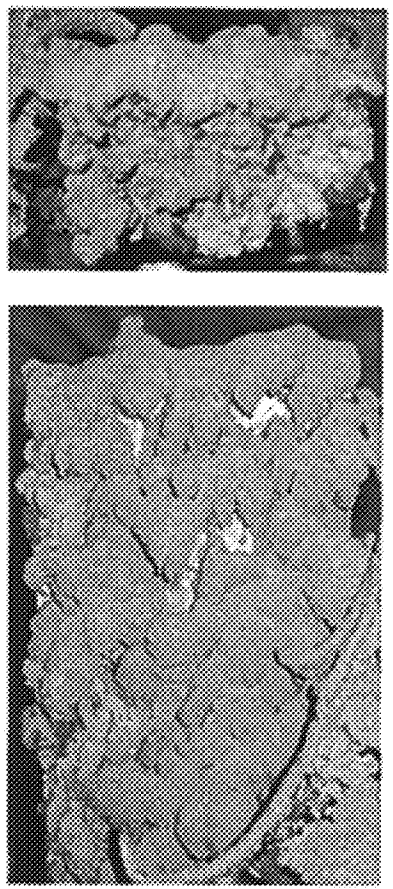

Referring to FIGS. 21 and 22, various specimens of Test Sample J were utilized to re-direct a droplet spray of a molten metallic material as described above for different lengths of time. In these evaluations, at least the vertical and top surfaces of the specimens were comprised of 1018 cold-rolled steel and were polished in accordance with at least one of the techniques described herein. Referring to FIG. 21, a first Test Sample J (FIG. 21 (*a*)) was exposed to a droplet spray for approximately 25 seconds and a second Test Sample J (FIG. 21 (*b*)) was exposed to the droplet spray for approximately 120 seconds where both test samples were provided with a supply of nitrogen gas having a pressure of approximately 1.9 bar. As illustrated in FIG. 21, there was minimal overspray deposit visible on the both of the gas injectors. Such a result indicates that the various gas injectors described herein could be operated for extended periods of time. In a similar evaluation, referring to FIG. 22, a first Test Sample J (FIG. 22(*a*)) was exposed to a droplet spray for approximately 25 seconds and a second Test Sample J (FIG. 22(*b*)) was exposed to the droplet spray for approximately 120 seconds where both test samples were provided with a supply of nitrogen gas having a pressure of approximately 0.5 bar. As illustrated in FIG. 22, very little overspray accumulated on the first test sample (FIG. 22(*a*)) while only somewhat more overspray accumulated on the second test sample (FIG. 22(*b*)) further supporting the use of the gas injectors for extended periods of time. By way of comparison, first and second Control Samples E, i.e., samples which do not have gas injectors, were exposed to a droplet spray for approximately 120 seconds and, as illustrated in FIG. 23, such control samples exhibited a significant accumulation of overspray thereon.

During at least several actual examples, it was observed that less overspray accumulated on the top surfaces of test samples which were oriented, or sloped, in a direction substantially parallel to the outside perimeter of the spray cone. Correspondingly, it was also observed that top surfaces oriented in directions which were increasingly closer to being transverse to the outside perimeter of the droplet spray accumulated more overspray thereon. Thus, it is apparent that the top surface of the gas injector preferably should be angled so as to substantially match, if not exceed, the angle of the spray cone in order to reduce the accumulation of overspray. In at least one such embodiment, as described above, the angle of the spray cone was determined to be approximately 67 degrees and, thus, the top surface would be optimally oriented at an approximately 67 degree, or greater, angle with respect to the horizontal, i.e., a plane perpendicular to the axis of the droplet spray.

Embodiments of the present invention are envisioned in which the configuration of passageway 38 can be changed. In various embodiments, referring to FIGS. 1 and 2, upper portion 33 of gas injector 32 can be articulated with respect to plate 36. In such embodiments, upper portion 33 can be moved relative to plate 36 to increase or decrease the size of passageway opening, or gap, 39. When the size of passageway opening 39 is altered, the pressure and the velocity of the gas exiting opening 39 will be affected. Such a relationship between pressure and velocity of a fluid is known as the "Venturi effect". In various embodiments, gas injector 32 can include elements which can be actuated to selectively constrict the flow of gas through passageway 38. The constriction of passageway 38 can affect the flow of gas therethrough, as described above.

In various embodiments, a gas injector can be integrally formed with a mold. In at least one such embodiment, the mold can include an opening, passageway, and/or plenum formed therein which can be configured to receive an inert gas as described above. In various alternative embodiments, referring to FIG. 4, plate 36 of gas injector 32 can be welded to mold 20. Weld bead 37 can be configured to seal the end of passageway 38 such that gas flowing into passageway 38 from manifolds 40 will flow through opening 39 as described above. Various other embodiments are envisioned in which a seal is created between gas injector 32 and mold 20, for example. In at least one such embodiment, bolts, for example, can be utilized to mount plate 36 to mold 20 and compress a seal or gasket positioned intermediate plate 36 and mold 20. In various alternative embodiments, the casting apparatus can include at least one gas injector that is positioned near the mold but is not mounted or attached to the mold. In various embodiments, a nucleated casting apparatus can include gas injectors positioned at different distances relative to the droplet spray. In at least one such embodiment, the casting apparatus can include a first, or inner, gas injector and a second, or outer, gas injector, for example. In various embodiments, the gas flow produced by the first gas injector can be oriented in a first direction and the gas flow produced by the second gas injector can be oriented in a second direction, where the first direction is different than the second direction.

In various embodiments, referring to FIGS. 1 and 2, the mold of the nucleated casting apparatus can be rotated relative to the gas injector. More particularly, in at least one embodiment, the casting apparatus can further include drive shaft 60 which can be integrally formed with, or otherwise connected to, side wall 21 of mold 20. In operation, drive shaft 60 can rotate side wall 21 about axis of rotation 58. In various embodiments, especially in embodiments where atomizing nozzle 22 is not directly centered above mold 20 along axis of rotation 58, the rotation of side wall 21 can reduce the accumulation of overspray on top surface 28. Such nucleated casting devices and methods are disclosed in a co-pending, commonly-owned United States patent application entitled REFINING CASTING APPARATUS AND METHOD, filed on Oct. 30, 2007, the disclosure of which is hereby incorporated by reference herein. In various embodiments, gas injector 32 can include bearing portion 54 which can be configured to rotatably support side wall 21 of mold 20. In at least one embodiment, the casting apparatus can further include a bearing positioned between side wall 21 and bearing portion 54 to facilitate relative movement between side wall 21 and bearing portion 54. Such a bearing can be comprised of any suitable material including, for example, brass. Referring to the illustrated embodiment, bearing portion 54 and side wall 21 can each include a track configured to receive ball bearings 56.

In various embodiments, referring to FIGS. 1 and 2, the mold of the nucleated casting apparatus can further include a base which is movable relative to the side wall of the mold. More particularly, in at least one embodiment, the casting apparatus can further include ram 62 connected to base 25 of mold 20 where, in operation, ram 62 can be configured to move base 25 relative to side wall 21 and withdraw preform 30 as it is being formed within mold 20. In such embodiments, a relatively constant distance can be maintained between the top surface of preform 30 and atomizing nozzle 22 and, as a result, the properties of the preform being cast can be more easily controlled. Furthermore, such embodiments can permit longer preforms to be cast. While an exemplary withdrawal mold is illustrated in FIGS. 1 and 2, any other suitable withdrawal mold can be used, including those disclosed in the co-pending, commonly-owned United States patent application entitled REFINING CASTING APPARATUS AND METHOD filed on Oct. 30,2007. In various embodiments, base 25 can also be rotated about axis 58 at the same speed as, or at a speed different than, side wall 21.

In various circumstances, as indicated above, if overspray is permitted to accumulate on mold 20 and it is not sufficiently removed, the overspray may block at least a portion of droplet spray 26 from entering mold 20 and thereby impede the proper formation of preform 30. Furthermore, as described above, the overspray may become welded to preform 30 and prevent preform 30 from being withdrawn relative to side wall 21. Such circumstances can reduce the output and profitability of the nucleated casting process and negatively affect the quality of cast preforms. In view of the above, gas injectors in accordance with the present invention can also be configured to direct a flow of gas which can dislodge overspray which has accumulated on top surface 28, for example, and direct it into mold 20. In at least one embodiment, the gas injectors can be configured to dislodge the overspray from top surface 28 such that it does not fall into mold 2. In either case, the gas injectors can be oriented to direct a gas flow at any suitable angle with respect to the top surface of the mold, for example, including a generally downward direction and/or a direction where the gas flow impinges on the side wall of the mold, for example.

It is to be understood that the present description illustrates those aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with certain embodiments, those of ordinary skill in the art will, upon considering the foregoing description, recognize that many modifications and variations of the invention may be employed. All such variations and modifications of the invention are intended to be covered by the foregoing description and the following claims.

What is claimed is:

1. An apparatus for producing a preform by nucleated casting, the apparatus comprising:

a mold comprising a side wall and a top surface, and wherein the side wall of the mold comprises a mold upper portion;

an atomizing nozzle adapted to produce a droplet spray directed toward the mold; and a gas injector comprising a plate and a gas injector upper portion, the gas injector adapted to produce a gas flow;

wherein the plate and the mold define a plurality of unconnected gas flow passageways therebetween, each gas flow passageway terminating in an opening positioned on a perimeter of the mold top surface; and wherein each of the plurality of gas flow passageways is configured to produce a gas flow at the opening of the gas flow passageway that redirects at least a portion of the droplet spray away from the side wall of the mold

2. The apparatus of claim 1, wherein a configuration of the opening of each of the plurality of gas flow passageways can be altered to change at least one of a size of the opening and a direction of the gas flow exiting the opening.

3. The apparatus of claim 1, wherein the gas injector upper portion comprises one of a rounded and a radiused edge surface that can be configured to adjust at least one of a direction of the gas flow and a profile of the gas flow.

4. The apparatus of claim 1, wherein the gas injector upper portion is articulable to change at least one of a size of the opening of each of the plurality of gas flow passageways and a direction of the gas flow.

5. The apparatus of claim 1, wherein the gas injector further comprises at least one actuated element to selectively constrict gas flow through the plurality of gas flow passageways.

6. The apparatus of claim 1, wherein the gas injector further comprises at least one manifold and at least one gas supply line, wherein the at least one manifold is configured to selectively fluidly connect the at least one gas supply line and the plurality of gas flow passageways.

7. The apparatus of claim 6, wherein the gas injector urther comprises at least one valve adapted to selectively restrict gas flow from the at least one gas supply line into the at least one manifold.

8. The apparatus of claim 6, wherein the plate is welded to the mold with at least one weld bead configured to seal the plurality of gas flow passageways so that gas flowing through the at least one manifold into the plurality of gas flow passageways is directed to the opening of each of the plurality of gas flow passageways.

9. The apparatus of claim 1, wherein the mold defines a perimeter, and the gas flow produced by the gas injector circumscribes the perimeter.

10. The apparatus of claim 1, wherein:

the mold further comprises a base;

the side wall is selectively rotatable about an axis of rotation; and the base is movable relative to the side wall along the axis of rotation to change a distance between the atomizing nozzle and the base.

11. The apparatus of claim 1, further comprising:

a melting and refining apparatus in fluid communication with the atomizing nozzle, wherein the melting and refining apparatus is selected from an electroslag remelting apparatus and a vacuum arc remelting apparatus.

12. The apparatus of claim 1, further comprising:

a chamber adapted to maintain a protective gas atmosphere therein, wherein the mold is positioned in the chamber.

13. The apparatus of claim 1, wherein at least one of the mold and the gas injector comprises a polished surface adapted to inhibit accumulation of the droplet spray on the polished surface.

14. The apparatus of claim 13, wherein the polished surface comprises an average surface roughness no greater than approximately 1 micrometer.

15. An apparatus for producing a preform by nucleated casting, the apparatus comprising:

a melting and refining apparatus selected from an electroslag remelting apparatus and a vacuum arc remelting apparatus;

a mold comprising a top surface, a side wall, and a mold upper portion;

an atomizing nozzle fluidly communicating with the melting and refining apparatus and adapted to produce a droplet spray directed towards the mold; and a gas injector comprising a plate and a gas injector upper portion, the gas injector adapted to produce a gas flow; and a chamber adapted to maintain a protective gas atmosphere therein, wherein at least the mold is positioned in the chamber;

wherein the plate and the mold define a plurality of gas flow passageways therebetween that are not in fluid communication with each other;

wherein each of the plurality of gas flow passageways comprises an opening, and the openings are positioned about a perimeter of the mold top surface; and wherein the opening of each gas flow passageway is configured to produce a gas flow in a direction that redirects at least a portion of the droplet spray away from at least one of the top surface of the mold and the side wall of the mold.

16. The apparatus of claim 15, wherein a configuration of the opening of each gas flow passageway is adjustable to change at least one of a size of the opening and a direction of the gas flow exiting the opening.

17. The apparatus of claim 15, wherein the gas injector upper portion comprises one of a rounded and a radiused edge surface that can be configured to affect at least one of a direction of the gas flow and a profile of the gas flow.

18. The apparatus of claim 15, wherein the gas injector upper portion is articulable to change at least one of a size of the gap and a direction of the gas flow.

19. The apparatus of claim 15, wherein the gas injector further comprises at least one actuated element adapted to selectively constrict gas flow through the plurality of gas flow passageways.

20. The apparatus of claim 15, wherein the gas injector further comprises at least one manifold and at least one gas supply line, wherein the at least one manifold is configured to selectively fluidly connect the at least one gas supply line and the plurality of gas flow passageways.

21. The apparatus of claim 20, wherein the at least one gas supply line further comprises at least one valve adapted to restrict gas flow from the at least one gas supply line into the at least one manifold.

22. The apparatus of claim 15, wherein the plate is welded to the mold with at least one weld bead configured to seal the plurality of gas flow passageways so that gas flowing through the at least one manifold into the plurality of gas flow passageways is directed to the opening of each of the gas flow passageways.

23. The apparatus of claim 15, wherein the mold defines a perimeter and a gas flow produced by the gas injector circumscribes the perimeter.

24. The apparatus of claim 15, wherein:

the mold further comprises a base;

the side wall is selectively rotatable about an axis of rotation; and the base is movable relative to the side wall along the axis of rotation to change a distance between the atomizing nozzle and the base.

25. The apparatus of claim 15, wherein at least one of the mold and the gas injector comprises a polished surface adapted to inhibit accumulation of the droplet spray on the polished surface.

26. The apparatus of claim 25, wherein the polished surface comprises an average surface roughness no greater than approximately 1 micrometer.

* * * * *